US007498867B2

(12) United States Patent
Satoh

(10) Patent No.: US 7,498,867 B2
(45) Date of Patent: Mar. 3, 2009

(54) CURRENT DRIVE CIRCUIT

(75) Inventor: Shinichi Satoh, Tokyo (JP)

(73) Assignee: Oki Semiconductor Co., Ltd. (JP)

( * ) Notice: Subject to any disclaimer, the term of this patent is extended or adjusted under 35 U.S.C. 154(b) by 0 days.

(21) Appl. No.: 11/716,651

(22) Filed: Mar. 12, 2007

(65) Prior Publication Data

US 2007/0279104 A1 Dec. 6, 2007

(30) Foreign Application Priority Data

Jun. 5, 2006 (JP) ..... 2006-155556

(51) Int. Cl.
*G05F 1/10* (2006.01)

(52) U.S. Cl. ..... 327/537; 327/534; 327/541; 327/546

(58) Field of Classification Search ..... 327/534; 326/33, 34; 345/76, 80, 92
See application file for complete search history.

(56) References Cited

U.S. PATENT DOCUMENTS

| | | | | |
|---|---|---|---|---|
| 5,461,338 | A * | 10/1995 | Hirayama et al. | 327/534 |
| 5,610,533 | A * | 3/1997 | Arimoto et al. | 326/33 |
| 5,874,851 | A * | 2/1999 | Shiota | 327/537 |
| 6,946,801 | B2 * | 9/2005 | Kitahara | 315/169.3 |
| 2003/0197473 | A1 * | 10/2003 | Kitahara | 315/169.3 |
| 2006/0226889 | A1 * | 10/2006 | Gupta et al. | 327/534 |

FOREIGN PATENT DOCUMENTS

JP 2004-013053 1/2004

* cited by examiner

*Primary Examiner*—Vibol Tan
(74) *Attorney, Agent, or Firm*—Studebaker & Brackett PC; Donald R. Studebaker

(57) ABSTRACT

In the current drive section, a wiring for setting a substrate potential is separately provided from a wiring of a power potential VDD so that substrate potentials of P-channel MOS transistors within respective drive cells become the same regardless of the distance from the power pad (power potential VDD) to each drive cell.

8 Claims, 16 Drawing Sheets

3c

CURRENT DRIVE CIRCUIT

BACKGROUND OF THE INVENTION

1. Field of the Invention

The present invention relates to a current drive circuit for a current-drive display unit that uses organic electroluminescent elements (referred to as "EL elements" hereinafter), light emitting diodes (referred to as "LED elements" hereinafter) or the like that emits light by being supplied with current.

2. Description of the Related Art

Generally, a displaying operation of a display unit using EL elements or LED elements is controlled by a constant current drive circuit (a constant current driver). One conventional constant current drive circuit is disclosed in Japanese Patent Application Kokai (Laid-Open) No. 2004-13053.

The constant current drive circuit of Japanese Patent Application Kokai No. 2004-13053 has a control voltage generating circuit section and a plurality of current output circuit sections for causing the display elements to emit light. The current output circuit sections are connected in parallel to the control voltage generating circuit section. Accordingly, a P-channel MOS transistor within the control voltage generating circuit section and a P-channel MOS transistor within each current output circuit section configure a current mirror circuit. Thus, constant current is generated from each current output circuit section.

In this constant current drive circuit, the source of the P-channel MOS (Metal Oxide Semiconductor) transistor in each current output circuit section is connected to a power-source pad via common wiring (power source wiring) and then to a power source potential from the power-source pad. Therefore, same power source potential is not supplied to the sources of the P-channel MOS transistors within the current output circuit sections because the voltage is decreased due to the resistance component(s) of the power source wiring. As a result, particularly in the current output circuit sections positioned away from the power-source pad, voltage $V_{GS}$ between the source and gate of the P-channel MOS transistor decreases, and thereby output current decreases.

Also, substrates of the P-channel MOS transistors within this constant current drive circuit are connected to the power-source pad via the shared wiring (power source wiring) and then to the power source potential from the power-source pad. Therefore, particularly in the current output circuit sections positioned away from the power-source pad, the potentials of the substrates of the P-channel MOS transistors decrease. Particularly in the current output circuit sections positioned away from the power-source pad, threshold voltages of the P-channel MOS transistors increase and the output currents decrease because of the substrate bias effect.

As described above, in the conventional constant current drive circuit, a value of the output current fluctuates in accordance with the position of the current output circuit section from the power-source pad. Hence, actually constant current cannot be generated with a high degree of accuracy.

SUMMARY OF THE INVENTION

Therefore, it is desirable to provide a current drive circuit capable of outputting constant current from each of current output circuit sections regardless of the distance thereto from the power-source pad even if the shared power source wiring is used from the power-source pad to the current output circuit sections (MOS transistors for current output).

According to a first aspect of the present invention, there is provided a current drive circuit including a first terminal which is set to a first reference potential, and a second terminal which is set to a second reference potential. The current drive circuit also includes a current drive section, which has a plurality of transistor elements whose source electrodes are connected in parallel to first wiring which is led from the first terminal. The current drive section generates drain current from each transistor element in accordance with a gate potential that is applied in common to gate electrodes of the transistor elements. A second wiring which is led from the second terminal is connected to substrates of the transistor elements of the current drive section.

A potential of the substrate of each transistor element of the current drive section is constant regardless of the distance thereto from the first terminal. Therefore, the substrate bias effect is not generated, and the output currents (drain currents) of the transistor elements that are positioned away from the first terminal are prevented from decreasing.

Regardless of the distance from the power-source pad, there is less or substantially no fluctuation in the output current generated by each transistor element. Therefore, fluctuation in light emission of light-emitting elements that emit light by means of the supplied output current is reduced.

According to a second aspect of the present invention, there is provided another current drive circuit including a first terminal which is set to a first reference potential, and a fourth terminal which is set to a fourth reference potential. This current drive circuit also includes a main current drive section which has a plurality of first transistor elements whose source electrodes and substrates are connected in parallel to the first terminal. The main current drive generates drain current as output current from each first transistor element in accordance with a gate potential. The current drive circuit also includes a sub current drive section which has a plurality of second transistor elements that are associated with the first transistor elements of the main current drive section, respectively. The second transistor elements have source electrodes and substrates which are connected in parallel to the fourth terminal. The gate electrode of each second transistor element is connected to the source electrode of a corresponding first transistor element of the main current drive section.

A source potential decreases between the first transistor element proximal to the first terminal and the first transistor element distal from the first terminal. The source potential decreases with the distance from the first terminal. Even when the drain current decreases, operating voltage (gate-to-source voltage) increases with the distance from the first terminal because the gate electrode of each second transistor element of the sub current drive section is connected to the source electrode of the corresponding first transistor element of the main current drive section. Therefore, decrease of the drain voltage in the main current drive section is complemented by the sub current drive section.

According to a third aspect of the present invention, there is provided still another current drive circuit including a first terminal which is set to a first reference potential, and a fifth terminal which is set to a fifth reference potential. The fifth reference potential is lower than the first reference potential. This current drive circuit also includes a current drive section which has a plurality of transistor elements whose source electrodes are connected in parallel to a first wiring which is led from the first terminal. The current drive section generates drain current from each transistor element in accordance with a gate potential which is applied to gate electrodes of the transistor elements. The current drive circuit also includes a potential setting section which causes the gate potentials of the transistor elements to decrease sequentially starting from the transistor element proximal to the first terminal to the transistor element distal from the first terminal.

The potential setting section causes the gate potentials of the transistor elements to decrease sequentially from the nearest transistor element (transistor element proximal to the first terminal) to the farthest transistor element (transistor element distal from the first terminal). Therefore, even when the source potentials decrease between the transistor element proximal to the first terminal and the transistor element distal from the first terminal of the current drive section, the operating voltage (gate-to-source voltage) becomes substantially constant in each transistor element in the current drive section regardless of the distance from the first terminal.

DETAILED DESCRIPTION OF THE INVENTION

Figure 1:
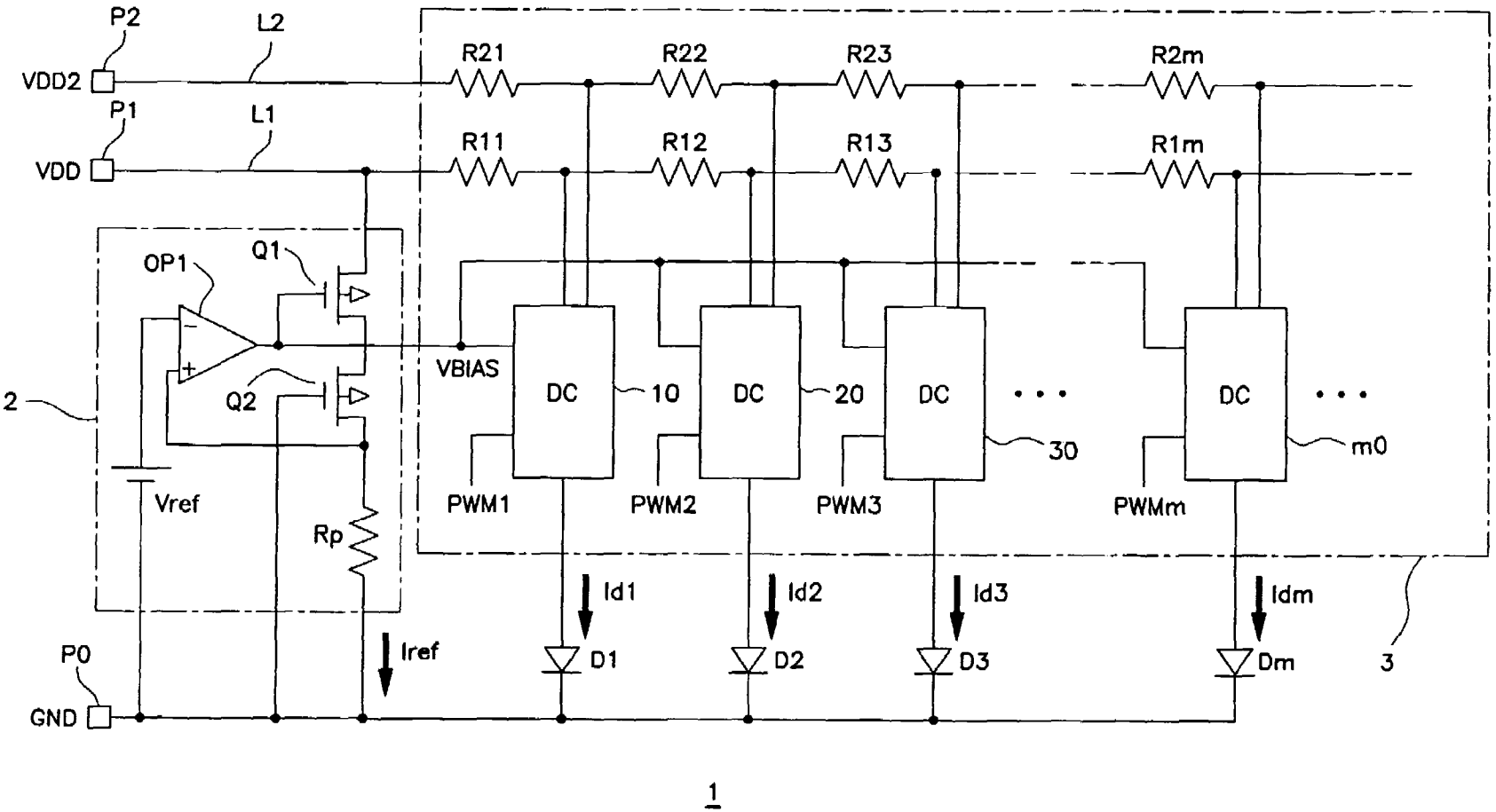
FIG. 1 shows a circuit configuration of the current drive circuit according to a first embodiment of the present invention.

Nine embodiments of the present invention are described hereinafter. The current drive circuit of each embodiment is mounted on an integrated circuit (IC) having a plurality of pads (input-output terminals). Similar reference numerals and symbols are used to indicate similar elements in all the embodiments.

First Embodiment

The first embodiment of the current drive circuit of the present invention is described with reference to FIG. 1 and FIG. 2.

First, a configuration of a current drive circuit 1 according to the present embodiment is described with reference to FIG. 1. The current drive circuit 1 is mounted on the IC.

As shown in FIG. 1, the current drive circuit 1 has a reference voltage generating circuit section 2 and a current drive section 3 for generating constant current to light-emitting emitting elements D1, D2, D3, . . . , Dm. The reference voltage generating circuit section 2 generates a bias potential $V_{BIAS}$ for controlling the magnitude of output current of the current drive section 3. The light-emitting elements D1, D2, D3, . . . , Dm are current luminescent elements such as EL elements or LED elements.

In the current drive section 3, there are provided drive cells (DC) 10, 20, 30, . . . , m0 that generate current for causing the light-emitting elements D1, D2, D3, . . . , Dm to emit light, respectively. The drive cells 10, 20, 30, . . . , m0 supply current Id1, Id2, Id3, . . . , Idm to the light-emitting elements D1, D2, D3, . . . , Dm, respectively.

The current drive section 3 is connected to a pad P1 (first terminal) which is applied with a power source potential VDD (first reference potential), and to another pad P2 (second terminal) which is applied with a potential VDD2 (second reference potential). The current drive section 3 is connected to the anodes of the light-emitting elements D1, D2, D3, . . . , Dm. The cathodes of the light-emitting elements D1, D2, D3, . . . , Dm are connected to a pad PO which is applied with a ground potential GND.

The drive cells 10, 20, 30, . . . , m0 activate or deactivate (turns on or off) the corresponding outputs of current Id1, Id2, Id3, . . . , Idm in response to PWM (Pulse Width Modulation) signals PWM1, PWM2, PWM3, . . . , PWMm that are given individually.

Figure 2:
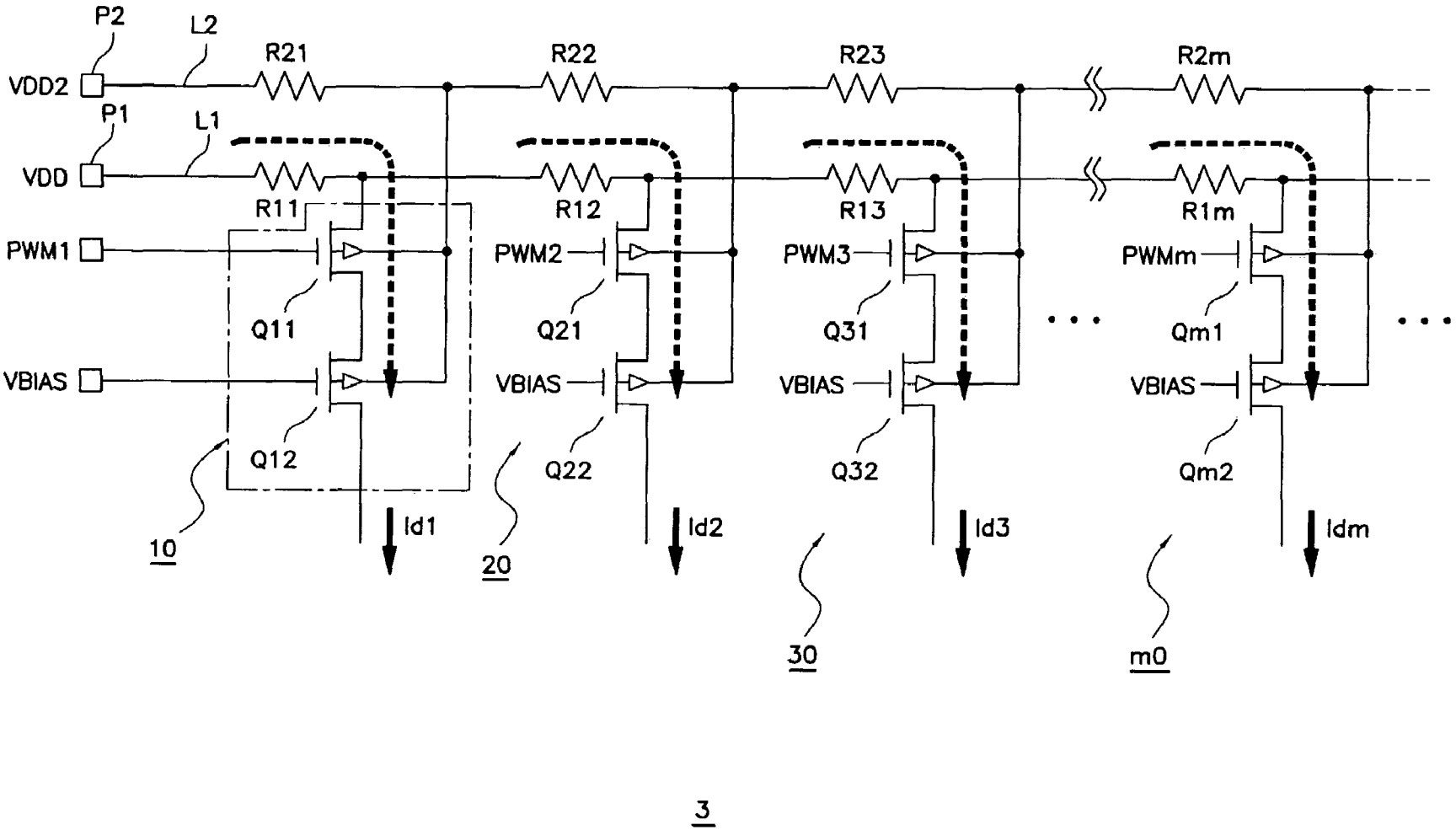
FIG. 2 is a circuit diagram of a current drive section according to the first embodiment.

FIG. 2 is a circuit diagram of the current drive section 3. As shown in FIG. 2, each of the drive cells 10, 20, 30, . . . , m0 has two P-channel MOS transistors. For example, the drive cell 10, which is closest to the pad P1, has two P-channel MOS transistors Q11, Q12, and the drive cell m0, which is farthest from the pad P1, has two P-channel MOS transistors Qm1, Qm2.

A plurality of resistance components R11, R12, . . . , R1*m* are serially positioned as parasitic resistances on wiring L1 (first wiring) which is led from the pad P1 (power source potential VDD). A plurality of resistance components R21, R22, . . . , R2*m* are serially positioned as parasitic resistances on wiring L2 (second wiring) which is led from the pad P2 (potential VDD2), and the end of the second wiring L2 is opened or has high impedance.

In each of the drive cells 10, 20, 30, . . . , m0, a drain electrode of one of the two P-channel MOS transistors Q11, Q21, . . . , Qm1 is connected to a source electrode of the mating P-channel MOS transistor Q12, Q22, . . . , Qm2. The drain electrode of each of the P-channel MOS transistors Q12, Q22, . . . , Qm2 is connected to the anode of the light-emitting element D1, D2, D3, . . . , Dm of the associated drive cell.

As shown in FIG. 1, the reference voltage generating circuit section 2 is connected to the power source potential VDD and ground potential GND. Inside the reference voltage generating circuit section 2, there are provided P-channel MOS transistors Q1, Q2, and an operational amplifier circuit OP1.

The P-channel MOS transistor Q1 has the same dimension as the P-channel MOS transistor Q11, Q21, . . . , Qm1 in the drive cell 10, 20, . . . , m0 or a dimension that is proportional to that of each P-channel MOS transistor Q11, Q21, . . . , Qm1.

The operational amplifier circuit OP1 receives a reference voltage $V_{ref}$ and a drain output potential of the P-channel MOS transistor Q2, and generates the bias potential $V_{BIAS}$. The bias potential $V_{BIAS}$ is supplied to the P-channel MOS transistor Q1 and also supplied in common to gate electrodes of the P-channel MOS transistors Q11, Q21, . . . , Qm1 inside the drive cells 10, 20, . . . , m0 respectively, whereby a current mirror circuit is formed.

The source electrode of the P-channel MOS transistor Q2 is connected to the drain electrode of the P-channel MOS transistor Q1, and a resistance component Rp is connected to the drain electrode of the P-channel MOS transistor Q2.

The operational amplifier circuit OP1 controls the bias potential $V_{BIAS}$ so that the reference voltage $V_{ref}$ (potential of an inverting input terminal of the operational amplifier circuit OP1) and a potential of the resistance R1 (potential of a non-inverting input terminal of the operational amplifier OP1) become equal to each other. Thus, the output current $I_{ref}$ of the P-channel MOS transistor Q1 is maintained at a constant value which is determined by the reference voltage $V_{ref}$ and the resistance value of the resistance component Rp.

Since the P-channel MOS transistor Q1 and the P-channel MOS transistors Q11, Q21, . . . , Qm1 within the drive cells 10, 20, m0 form the current mirror circuit, the output current Id1, Id2, . . . , Idm of each drive cell 10, 20, . . . , m0 becomes equal to or proportional to the output current $I_{ref}$ supplied from the drain of the P-channel MOS transistor Q1. If a voltage drop due to power source wiring is not considered, the output current Id1, Id2, . . . , Idm is maintained constant.

Next, the circuit configuration of a current drive section of a conventional current drive circuit (referred to as "reference circuit" hereinafter) is described for the purpose of clarifying the structural characteristics of the current drive circuit 1 of this embodiment.

Figure 3:
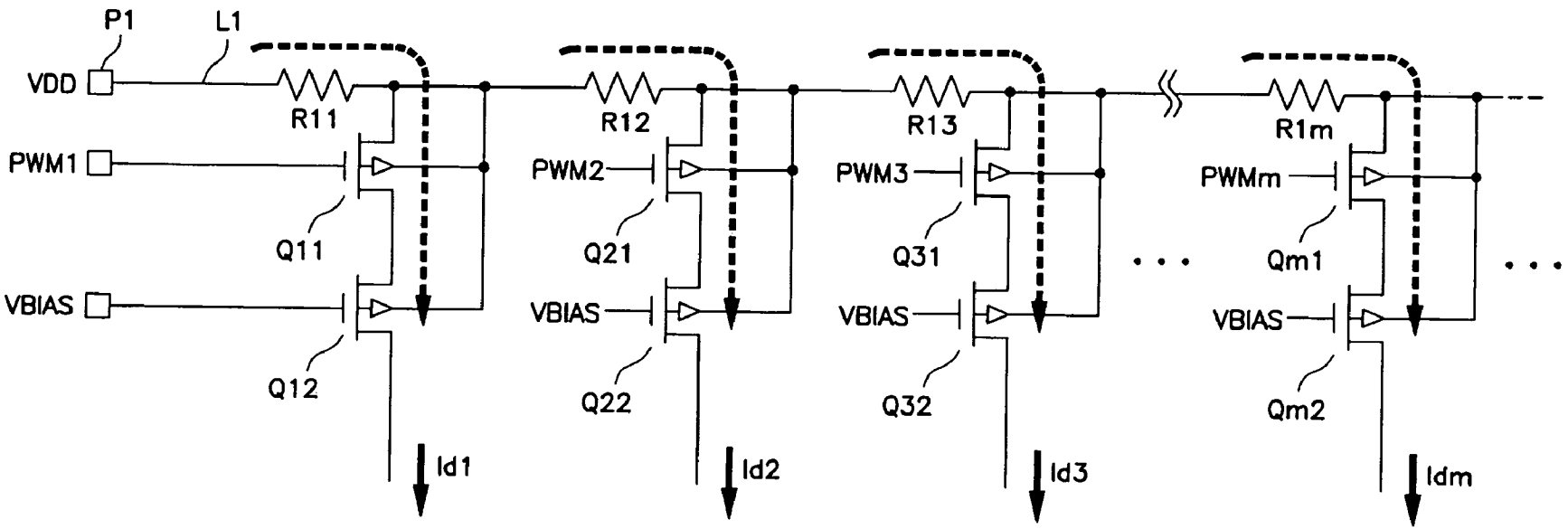
FIG. 3 PRIOR ART
FIG. 3 is a circuit diagram of a circuit (reference circuit) of a conventional current drive section.

FIG. 3 is a circuit diagram of the reference circuit. This reference circuit is different from the current drive section 3 of FIG. 1 in that, in the reference circuit, the source electrode of one P-channel MOS transistor Q11, Q21, . . . , Qm1 inside each drive cell and substrates of the two P-channel MOS transistors (Q11 and Q12, for example) within the same drive cell are connected to a common node on the wiring L1 which is led from the pad P1 (power source potential VDD).

In FIG.3, the resistance components R11, R12, . . . , R1*m* are parasitic resistances existing on the power source wiring L1. Due to the voltage decrease caused by the parasitic resistances, the source potentials of the P-channel MOS transistors Q12, Q22, . . . , Qm2 within the drive cells decrease, starting from the drive cell proximal to the pad P1 on the IC substrate to the drive cell distal from the pad P1. Accordingly, the source-to-gate voltage $V_{GS}$ decreases.

Specifically, in the reference circuit, the source potentials Ps1, Ps2, . . . , Psm of the P-channel MOS transistors Q11, Q21, . . . , Qm1 decrease starting from the drive cell proximal to the pad P1 to the drive cell distal from same, as shown in the following equations (1) through (3).

$$Ps1=VDD-R11\times(Id1+Id2+\ldots+Idm) \quad (1)$$

$$Ps2=VDD-R11\times(Id1+Id2+\ldots+Idm)-R12\times(Id2+Id3+\ldots+Idm) \quad (2)$$

. . .

$$Psm=VDD-R1\times(Id1+Id2+\ldots+Idm)-R12\times(Id2+Id3+\ldots+Idm)-\ldots-R1m\times Idm \quad (3)$$

In the drive cells of the reference circuit, the source electrode and substrate of each P-channel MOS transistor are connected to the power source wiring extending from the pad P1 (power source potential VDD). Thus, the substrate potential of each P-channel MOS transistor decreases starting from the drive cell proximal to the pad P1 on the IC substrate to the drive cell distal from same. Because of the substrate bias effect, the farther the P-channel MOS transistors within the drive cells are positioned from the pad P1, the higher the threshold becomes.

In the reference circuit shown in FIG. 3, therefore, the output currents Id1, Id2, . . . , Idm decrease starting from the drive cell near the pad P1 on the IC substrate to the drive cell positioned away from the same, and actually the constant current is not produced although the current mirror is formed.

Now, the operation of the current drive circuit 1 of the first embodiment is described.

Referring back to FIG. 2, the constitutional difference between the current drive section 3 of this embodiment and the reference circuit (FIG. 3) is that a potential which is set on the source electrode of each P-channel MOS transistor Q11, Q21, . . . , Qm1 in each drive cell is independent (separate) from the potential which is set on the substrates of the two P-channel MOS transistors (Q11 and Q12, for example) in the same drive cell. One end of the wiring L2 that is led from the pad P2 is an open end (high impedance), and therefore current does not flow into the resistance components R21, R22, . . . , R2*m*. Also, the substrate potentials of the two P-channel MOS transistors (Q11 and Q12, for example) within each drive cell become the same (i.e., VDD2).

On the other hand, the output current flows from each drive cell into the power source wiring L1 which is led form the pad P1. Thus, the current drive circuit 1 of the first embodiment is similar to the reference circuit in that the voltage decrease is caused by the resistance components R11, R12, . . . , R1*m* on the wiring L1. However, the substrate potentials of the P-channel MOS transistors within the drive cells do not change, regardless of the distance from the pad P1 to the drive cells. Thus, there is no substrate bias effect. Therefore, the fluctuation of the output currents from the drive cells of the current drive circuit 1 of this embodiment is smaller than that of the reference circuit in which the substrate bias effect is generated.

As described above, in the current drive section 3 of the current drive circuit of the first embodiment, wiring for setting the substrate potential is provided separately from the wiring of the power potential VDD so that the P-channel MOS transistors within the drive cells have the same substrate potential regardless of the distances between the pad P1 (power potential VDD) and the drive cells. Thus the substrate bias effect is not generated, and current output characteristics for the light emitting elements are improved.

It should be noted that the potential VDD2 may be the same as the power potential VDD, in which case the wiring L2 can be branched from the wiring L1 in the vicinity of the pad P1, and therefore the pad P2 is not required.

Second Embodiment

The current drive circuit according to each of the second to ninth embodiments is different from the current drive circuit 1 of the first embodiment (FIG. 1) in terms of the current drive section only. Therefore, in each of the second to ninth embodiments, only the current drive section is described.

Figure 4:
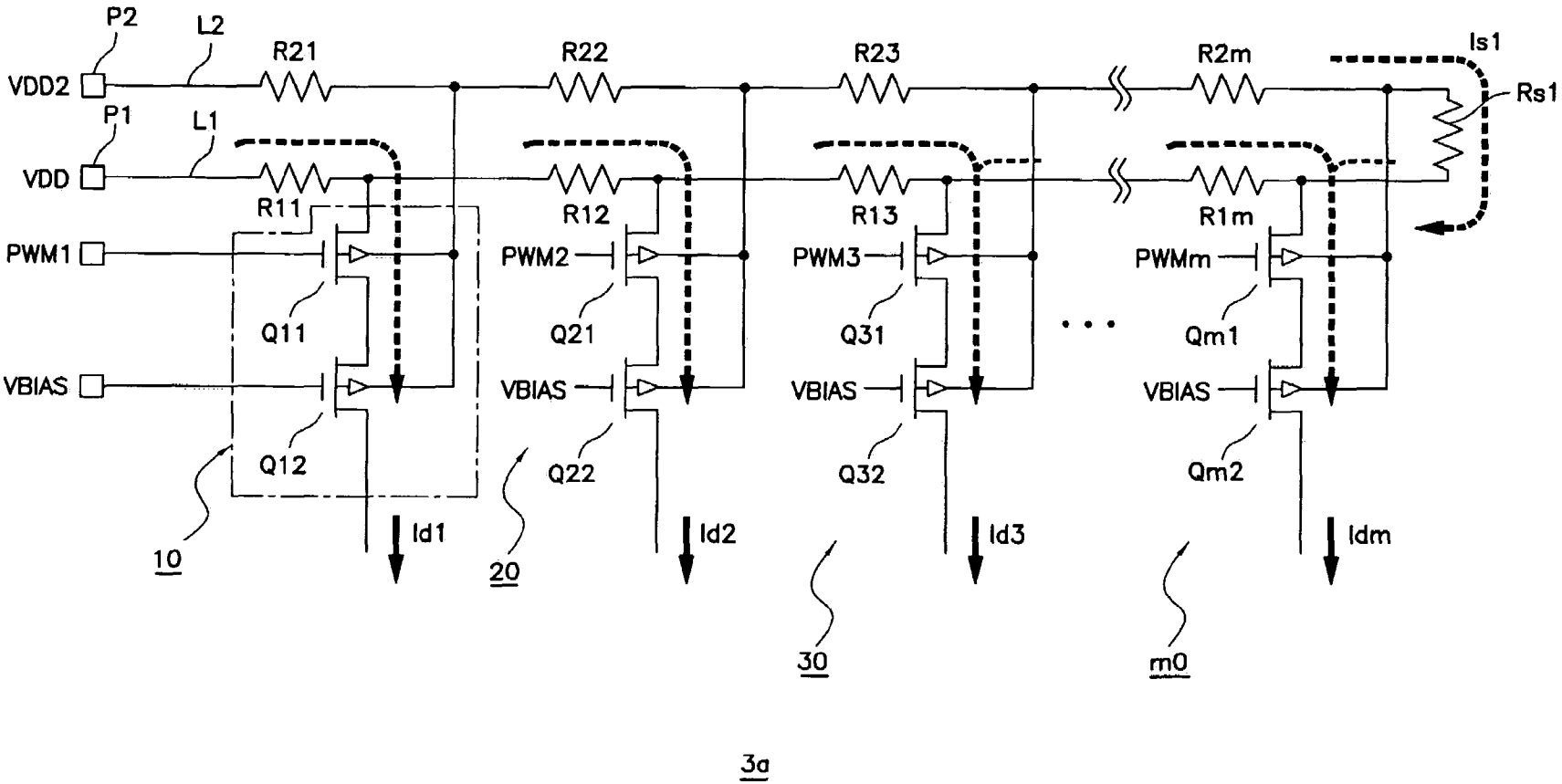
FIG. 4 is a circuit diagram of a current drive section according to a second embodiment of the present invention.

FIG. 4 is a circuit diagram showing a current drive section 3*a* of the second embodiment. This current drive section 3*a* is different from the current drive section 3 of the first embodiment in that the wiring L1 and wiring L2 are connected with each other in the P-channel MOS transistor Qm1 that is positioned farthest from the pad P1 (power potential VDD).

A configuration of the current drive section 3*a* of the second embodiment is described with reference to FIG. 4.

As shown in FIG. 4, the wiring L1 and wiring L2 are connected with each other via a resistance component Rs1 at a position farthest from the pad P1. Unlike the current drive section 3, the current drive section 3*a* of this embodiment is designed to apply minimal current to the wiring L2. Thus, it is preferred that the resistance components on the wiring L2 be somewhat large as a series resistance.

As shown in FIG. 4, on the wiring L1 that is led from the pad P1 (power potential VDD), a plurality of resistance components R11, R12, . . . , R1*m* are positioned serially as parasitic resistances. Specifically, in this circuit configuration, the source electrode of each P-channel MOS transistor Q11, Q21, . . . , Qm1 in each drive cell is connected to the wiring L1 at a node between two adjacent resistance components. For example, the source electrode of the P-channel MOS transistor Q11 is connected to the wiring L1 between the resistance component R11 and resistance component R12, and the source electrode of the P-channel MOS transistor Q21 is connected to the wiring L1 between the resistance component R12 and resistance component R13.

Similarly, the substrates of the two P-channel MOS transistors (Q11 and Q12; Q21 and Q22; Q31 and Q32; . . . ; Qm1 and Qm2) in each drive cell are connected to the wiring L2 at a node between two adjacent resistance components. For example, the substrates of the P-channel MOS transistors Q11 and Q12 are connected to the wiring L2 between the resistance component R21 and resistance component R22, and the substrates of the P-channel MOS transistors Q21 and Q22 are connected to the wiring L2 between the resistance components R22 and resistance component R23.

In the current drive section 3*a*, the substrate potentials of all the P-channel MOS transistors in the drive cells are made uniform as much as possible regardless of the distance between the pad P1 and the drive cells. To this end, the value of each resistance component disposed on the wiring L2 is decided so that the current Is1 that flows in the wiring L2 led from the pad P2 (potential VDD2) is minimal.

In FIG. 4, for example, the current Is1 is controlled (suppressed, reduced) by setting the value of the resistance component Rs1 to a value larger than the values of the resistance components R21, R22, . . . , R2*m*, so that decrease of voltage is hardly caused by the resistance components R21, R22, . . . , R2*m*. Accordingly, the substrate potentials of the P-channel MOS transistors in all the drive cells become substantially equal to the potential VDD2.

It should be noted that the resistance components R21, R22, . . . , R2*m* and the resistance component Rs1 configure a first resistance section of the present invention.

Although not particularly limited, the values of the resistance components R11, R12, . . . , R1*m* on the wiring L1 extending from the pad P1 (power potential VDD) are set to as a small value as possible.

Next, the operation of the current drive section 3*a* is described with reference to FIG. 2.

As described above, in the current drive section 3*a* shown in FIG. 4, the small current Is1 is only allowed to flow by assigning a larger resistance to the resistance component Rs1 than the resistance components R21, R22, . . . , R2*m*, and a smaller voltage drop is only caused by the resistance components R21, R22, . . . , R2*m*.

The substrate potential Pbm of the P-channel MOS transistors Qm1 and Qm2 in the drive cell positioned farthest from the pad P1 (power potential VDD) is given by the following equation (4). Because the value of the current Is1 flowing through the resistance component Rs1 is very small, the second item in the equation (4) can be ignored. Thus, the value of the substrate potential Pbm becomes substantially equal to the value of the potential VDD2.

Therefore, the substrate bias effect in the current drive section 3*a* is extremely small, and fluctuation (decrease) in current in each drive cell is reduced (restricted).

$$Pbm = VDD2 - Is1 \times (R21 + R22 + \ldots + R2m) \tag{4}$$

On the other hand, in the current drive section 3*a*, the current Is1 flowing through the wiring L2 flows into the wiring L1. Therefore, the source potential Psm of the P-channel MOS transistor Qm1 in the drive cell m0 is given by the following equation (5):

$$\begin{aligned} Psm &= VDD - R11 \times (Id1 + Id2 + \ldots + Idm - Is1) - \\ &\quad R12 \times (Id2 + Id3 + \ldots + Idm - Is1) - \ldots - R1m \times (Idm - Is1) = \\ &\quad VDD - R11 \times (Id1 + Id2 + \ldots + Idm) - \\ &\quad R12 \times (Id2 + Id3 + \ldots + Idm) - \ldots - \\ &\quad R1m \times Idm + (R11 + R12 + \ldots + R1m) \times Is1 \end{aligned} \tag{5}$$

As is clear from the comparison between the equation (5) and the equation (3) for the reference circuit, the potential Psm of the P-channel MOS transistor Qm1 in the drive cell m0 positioned farthest from the pad P1 (power source potential VDD) in the current drive circuit 1 of this embodiment is larger than the value in the reference circuit by (R11+R12+ . . . +R1*m*)×Is1 (the last item in the equation (5)). Specifically, fluctuation of the source potential due to the distance between the pad P1 and the drive cell is small in the current drive circuit 1, compared to the reference circuit, and therefore fluctuation of the gate-to-source voltage $V_{GS}$ becomes small and fluctuation of the output current Id1, Id2, . . . , Idm from each drive cell can be reduced.

As described above, in the current drive circuit 1 of the second embodiment, fluctuation of the substrate potential and source potential in each P-MOS transistor in each drive cell can be suppressed regardless of the distance from the pad P1 (power potential VDD) to the drive cell. Thus, the output currents from the drive cells can be made substantially constant.

Third Embodiment

Next, the third embodiment of the current drive circuit of the present invention is described with reference to FIG. 5.

The current drive section of the current drive circuit of the third embodiment is same as that of the current drive circuit 1 of the first embodiment in terms of the function, i.e., a potential is individually (separately) set for the source electrode of each P-channel MOS transistor Q11, Q21, . . . , Qm1 of each drive cell and for the substrate of two P-channel MOS transistors (Q11 and Q12, for example) of each drive cell. However, the configuration of the current drive section of the third embodiment is different that of the first embodiment.

First, a configuration of a current drive section 3*b* according to the third embodiment is described.

Figure 5:
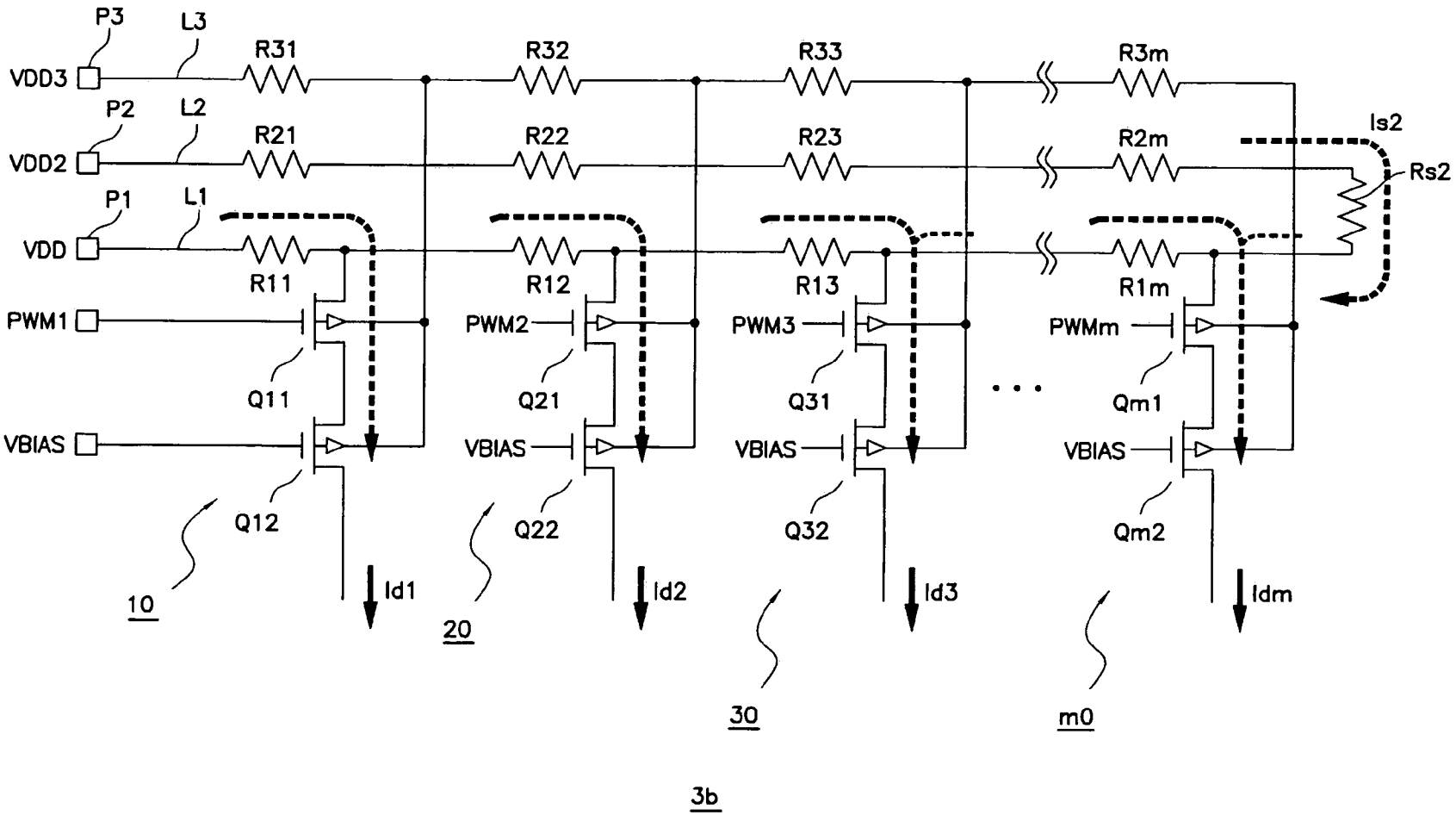
FIG. 5 illustrates a circuit configuration of a current drive section within a current drive circuit according to a third embodiment of the present invention.

FIG. 5 illustrates a circuit configuration of the current drive section 3*b*. This current drive section 3*b* is different from the current drive section 3*a* (FIG. 4) of the second embodiment in terms of the circuit configuration between the pad group and each drive cell.

The current drive section 3*b* has a pad P3 (second terminal) applied with a potential VDD3 (second reference potential), and a plurality of resistance components R31, R32, . . . , R3*m* are serially connected to a wiring L3 (second wiring) which is led from the pad P3. The resistance components R31, R32, . . . , R3*m* are parasitic resistances on the wiring L3, but current does not flow in the wiring L3 so that the size of each resistance does cause any operational problems.

As shown in FIG. 5, in the circuit configuration, the substrates of the two P-channel MOS transistors (Q11 and Q12; Q21 and Q22; . . . ; Qm1 and Qm2) in each drive cell are connected to the wiring L3 at a node between two adjacent resistance components. For example, the substrates of the P-channel MOS transistors Q11 and Q12 are connected to the wiring L3 between the resistance component R31 and resistance component R32, and the substrates of the P-channel MOS transistor Q21 and Q22 are connected to the wiring L3 between the resistance component R32 and resistance component R33.

As shown in FIG. 5, on the wiring L1 that is led from the pad P1 (power potential VDD)., a plurality of resistance components R11, R12, . . . , R1*m* are positioned serially as parasitic resistances. In the circuit configuration, the source electrode of one P-channel MOS transistor Q11, Q21, . . . , Qm1 in each drive cell 10, 20, . . . , m0 is connected to the wiring L1 at the node between each two adjacent resistance components. For example, the source electrode of the P-channel MOS transistor Q11 is connected to the wiring L1 between the resistance component R11 and resistance component R12, and the source electrode of the P-channel MOS transistor Q21 is connected to the wiring L1 between the resistance component R12 and resistance component R13.

The wiring L2 that is led from the pad P2 (potential VDD2) is connected to the wiring L1, via a resistance component Rs2, in the P-channel MOS transistor Qm1 positioned farthest from the pad P1 (power potential VDD).

Next, the operation of the current drive section 3*b* of the third embodiment is described.

In the current drive section 3*b*, because the pad P3 (potential VDD3) and the substrate of each P-channel MOS transistor in each cell drive are connected with each other, the substrate potential of each P-channel MOS transistor is the potential VDD3 regardless of the power source potential VDD. In other words, the substrate potential of each P-channel MOS transistor in each drive cell is the potential VDD3 regardless of the distance from the pad P1 (power potential VDD) to the drive cell. Therefore, the substrate bias effect does not occur in the current drive section 3*b*, and fluctuation (decrease) of current in each drive cell is reduced.

Since the current drive section 3*b* is same as the current drive section 3*a* of the second embodiment in that current Is2 flowing through the wiring L2 flows into the wiring L1, fluctuation of the gate-to-source voltage $V_{GS}$ is also reduced and fluctuation of the output current Id1, Id2, . . . , Idm from each drive cell is reduced.

As described above, the current drive circuit according to this embodiment has the characteristics that the substrate bias effect is not caused (characteristic of the current drive section 3) and that decrease of the power source voltage is restricted (characteristic of the current drive section 3*a*). Thus, the current output characteristics that are enhanced more than those of the current drive circuits of the first and second embodiments can be obtained.

Fourth Embodiment

Next, the fourth embodiment of the current drive circuit of the present invention is described with reference to FIG. 6.

A current drive section of the current drive circuit of the fourth embodiment is same as the current drive section 3 (FIG. 2) of the first embodiment (if considered in the form of the equivalent circuit), but has a unique structure.

Figure 6:
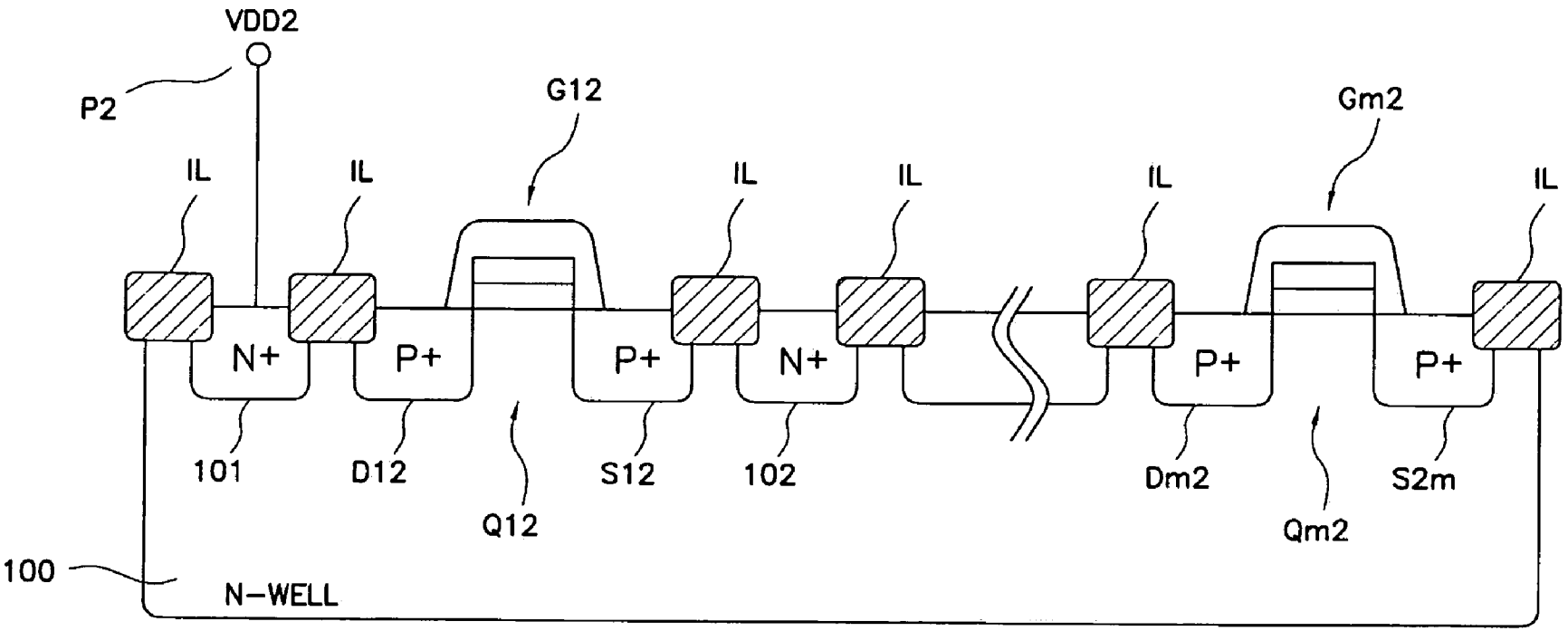
FIG. 6 is a cross-sectional view showing a structure of a current drive circuit according to a fourth embodiment of the present invention.

FIG. 6 is a cross-sectional view of the current drive section according to the fourth embodiment.

In this current drive section, the substrate potentials of the P-channel MOS transistors Q11, Q21, . . . , Qm1 and Q12, Q22, . . . , Qm2 are connected to the wiring L2 as shown in FIG. 2, but this wiring L2 is not a metal wiring. The wiring L2 is realized by utilizing an N-type well region (or N-type substrate) which forms the P-channel MOS transistors.

FIG. 6 is an example of a cross-sectional diagram showing a structure of the P-channel MOS transistors Q12, Q22, . . . , Qm2. As shown in FIG. 6, in this current drive section, the P-channel MOS transistors Q12, Q22, . . . , Qm2 are formed in an N-type well region 100. For example, the P-channel MOS transistor Q12 has a drain region (P+ region) D12, a source region (P+ region) S12, and a gate region G12 having a gate insulating film and gate electrode. The P-channel MOS transistor Qm2 has a drain region (P+ region) Dm2, a source region (P+ region ) Sm2, and a gate region Gm2 having a gate insulating film and gate electrode. An insulating region IL ($SiO_2$, for example) is provided between adjacent P-channel MOS transistors. The P-channel MOS transistors Q11, Q21, . . . , Qm1 have the same structure.

An N+ region 101 is formed near an end of the N-type well region 100. The N+ region 101 is connected to the pad P2 (VDD2 potential) through an upper metal wiring.

In this manner, all the P-channel MOS transistors within the current drive section are formed in the common well region (or substrate) so that the upper metal wiring for defining the wiring L2 is minimized.

It should be noted that the formation of all the P-channel MOS transistors in the common well region (or substrate) is performed not only in the current drive section 3 of the first embodiment but also in the current drive sections of the other embodiments.

Fifth Embodiment

Next, the fifth embodiment of the current drive circuit of the present invention is described with reference to FIG. 7.

Figure 7:
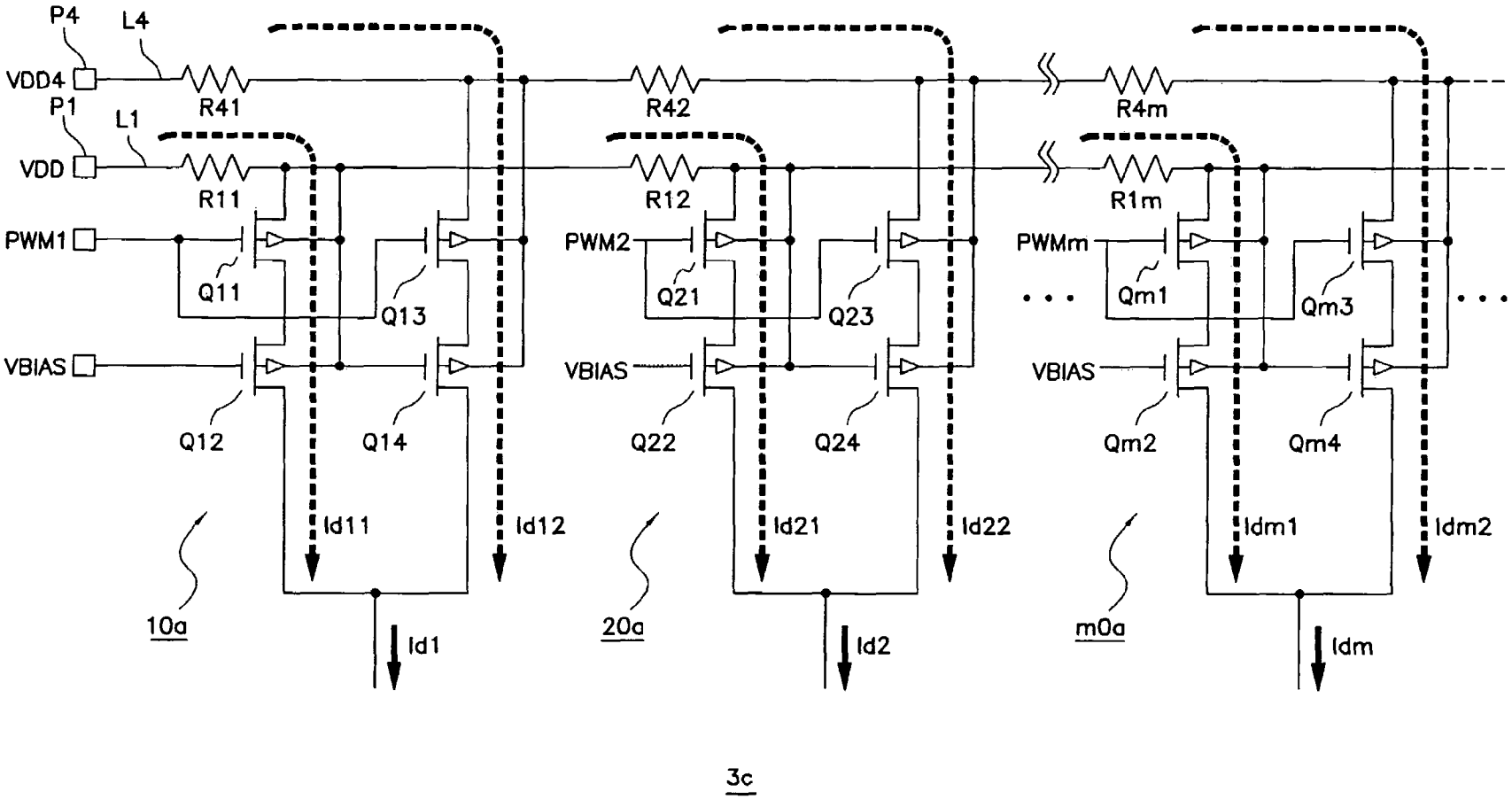
FIG. 7 is a circuit diagram of a current drive section in a current drive circuit according to a fifth embodiment of the present invention.

FIG. 7 is a circuit diagram of a current drive section 3*c* in the current drive circuit of the fifth embodiment. Compared to the reference circuit (FIG. 3), this current drive section 3*c* is characterized in that a transistor for current compensation ("sub current drive section" described hereinafter) is additionally provided in each drive cell.

A configuration of the current drive section 3*c* is described below.

In FIG. 7, the current drive section 3*c* has a plurality of drive cell 10*a*, 20*a*, . . . , m0*a* for generating current Id1, Id2, . . . , Idm. The circuit configuration in which two P-channel MOS transistors Q11 and Q12, Q21 and Q22, . . . , Qm1 and Qm2 in each drive cell are connected to the pad P1 (power potential VDD) is same as the reference circuit (FIG. 3). The two P-channel MOS transistors Q11 and Q12, Q21 and Q22, . . . , Qm1 and Qm2 in each drive cell generate current Id11, Id21, . . . , Idm1. The current Id11, Id21, . . . , Idm1 is the main current (primary part) of the output current Id1, Id2, . . . , Idm of each drive cell so that the two P-channel MOS transistors Q11 and Q12, Q21 and Q22, . . . , Qm1 and Qm2 are collectively called "main current drive section" hereinafter.

Other two P-channel MOS transistors Q13 and Q14, Q23 and Q24, . . . , Qm3 and Qm4 in each drive cell are transistors for compensating the output current so that the output current from each drive cell is kept constant. These two P-channel MOS transistors Q13 and Q14, Q23 and Q24, . . . , Qm3 and Qm4 in each drive cell generate current Id12, Id22, . . . , Idm2. The current Id12, Id22, . . . , Idm2 is auxiliary current (secondary part) for compensating the output current Id1, Id2, . . . , Idm of each drive cell. Thus, the two P-channel MOS transistors (Q13 and Q14; Q23 and Q24; . . . ; Qm3 and Qm4) are collectively called "sub current drive section" hereinafter.

For example, the drive cell 10*a*, which is positioned closest to the pad P1, has the P-channel MOS transistors Q13 and Q14 as the sub current drive section.

As with the P-channel MOS transistor Q11, the P-channel MOS transistor Q13 is a transistor in which the PWM signal PWM1 is controllably (selectively) applied to the gate electrode thereof and thereby an output of the current Id12 of the sub current drive section is activated or deactivated (turned on or off). The source of the P-channel MOS transistor Q13 is connected to a wiring L4 which is led from a pad P4 (fourth terminal) applied with a potential VDD4 (fourth reference potential). The drain electrode of the P-channel MOS transistor Q13 is connected to the source electrode of the P-channel MOS transistor Q14.

The gate electrode of the P-channel MOS transistor Q14 is connected to the substrates of the main current drive sections Q11 and Q12. Accordingly, in the P-channel MOS transistor Q14, the gate-to-source voltage $V_{GS}$ increases as the substrate potential of the main current drive section decreases, whereby more drain current Id12 can be supplied.

The substrates of the sub current drive sections are connected to the wiring L4 that is led from the pad P4 (potential VDD4).

The above has described the configuration of the drive cell 10*a* only, but the drive cells other than the drive cell 10*a* have the same configuration as the drive cell 10*a*.

In FIG. 7, the resistance components R11, R12, . . . , R1*m* are serially provided on the wiring L1 that is led from the pad P1 (power potential VDD), and these resistance components R11, R12, . . . , R1*m* are parasitic components on the power source wiring as with the reference circuit.

On the other hand, resistance components R41, R42, . . . , R4*m* are serially provided on the wiring L4 that is led from the pad P4 (potential VDD4).

Next, the operation of the current drive section 3*c* of the fifth embodiment is described.

In FIG. 7, the main current drive section Q11 and Q12, Q21 and Q22, . . . , Qm1 and Qm2 in each drive cell, the wiring L1 led from the pad P1 (power potential VDD), and the resistance components R11, R12, . . . , R1*m* arranged on the wiring L1 have the same configurations as those of the reference circuit shown in FIG. 3. Specifically, the source potential Ps1, Ps2, . . . , Psm of the P-channel MOS transistor Q11, Q21, . . . , Qm1 in each main current drive section decreases with distance from the pad P1 (see the equations (1) through (3)). Specifically, Ps1>Ps2> . . . >Psm is established.

Therefore, as described above, the current of the main current drive section is decreased by the substrate bias effect and the drop of the source-to-gate voltage $V_{GS}$ of the main current drive section, starting from the drive cell proximal to the pad P1 to the drive cell distal from the pad P1. Specifically, Id11>Id21> . . . >Idm1 is established.

On the other hand, the gate electrode of the P-channel MOS transistor Q14, Q24, . . . , Qm4 in the sub current section of each drive cell has the same potential as the source potential Ps1, Ps2, . . . , Psm of the P-MOS transistor Q11, Q21, . . . , Qm1 in the corresponding main current drive section. Therefore, starting from the drive cell proximal to the pad P1 to the drive cell distal from the pad P1, the gate-to-source voltages $V_{GS}$ of the P-channel MOS transistors Q14, Q24, . . . , Qm4 increase, and more current can be caused to flow. Specifically, Id12<Id22< . . . <Idm2 is established.

As shown in FIG. 7, the current drive section of this embodiment combines the current Id11, Id21, . . . , Idm1 of the main current drive section that gradually decreases starting from the drive cell proximal to the pad P1 (power potential VDD) to the drive cell distal from same, with the current Id12, Id22, . . . , Idm2 of the sub current drive section that gradually increases starting from the drive cell proximal to the pad P1 to the drive cell distal from same, and generates the output current Id1, Id2, . . . , Idm of each drive cell. Therefore, this current drive circuit can produce constant current from each drive cell regardless of the distance from the pad P1.

It should be noted that the amount of current required for the current compensation, which is performed by each drive cell, may vary with the dimensions of the sub current drive sections and the parasitic resistance components of the power source wiring. Thus, it is preferred to adjust the value of the potential VDD4 and the values of the resistance components R41, R42, . . . , R1*m* to optimize the amount of the required current for the current compensation.

Figure 8A:
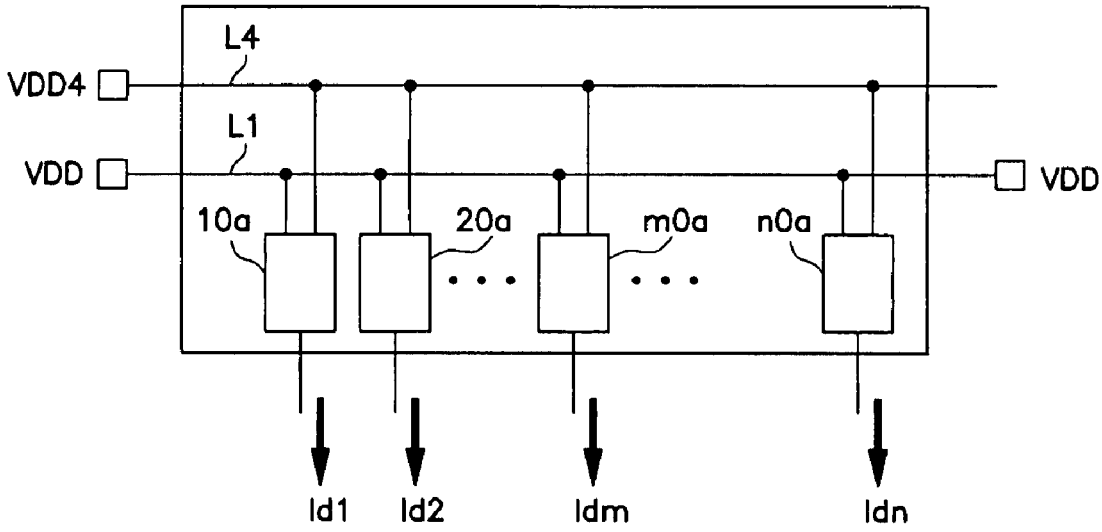
FIG. 8A illustrates a block diagram of the current drive section according to the fifth embodiment.
Figure 8B:
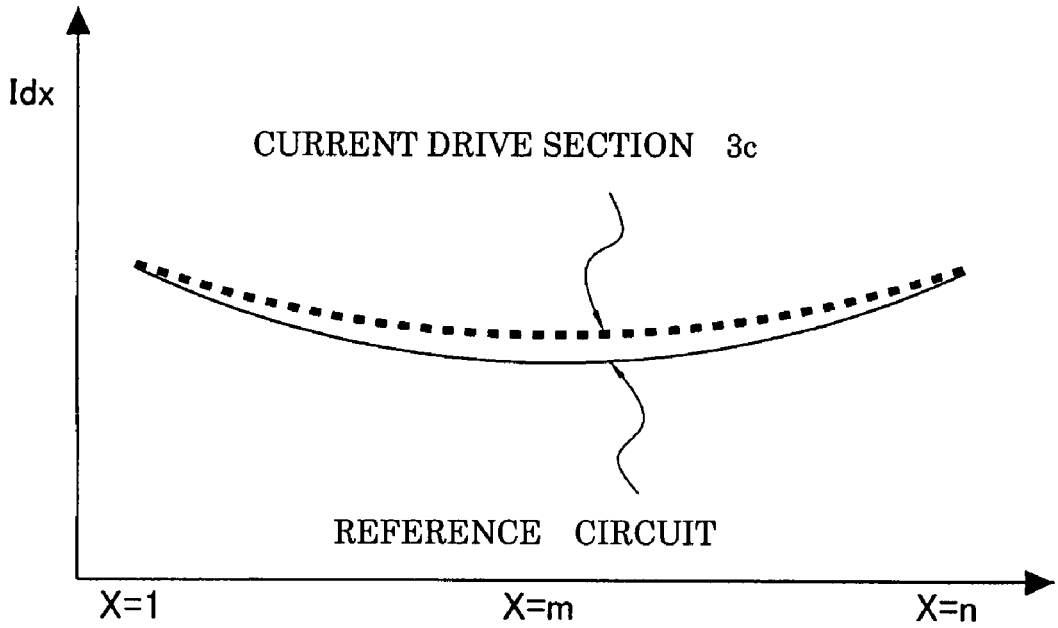
FIG. 8B illustrates current output characteristics of the current drive section (effects of the current drive circuit) according to the fifth embodiment.

FIG. 8A and FIG. 8B are figures useful to explain the advantages of the current drive section 3*c* of the fifth embodiment. FIG. 8A is a block diagram of the current drive section 3*c*, and FIG. 8B illustrates the current output characteristics of the current drive section 3*c*, which is compared with the reference circuit. In FIG. 8B, the horizontal axis represents the position of the drive cell and the vertical axis represents the output current of the drive cell. In the current drive section 3*c* shown in FIG. 8A, the wiring L1 is applied with the power potential VDD from both end electrodes of the wiring L1.

When the power potential VDD is applied from both ends of the wiring L1 in the reference circuit, the current decreases starting from the drive cell proximal to the electrode (power potential VDD) to the drive cell distal from the electrode. Specifically, as indicated by the solid line curve in FIG. 8B, the current output characteristics of the reference circuit show a concave curve in which the current output of the drive cell positioned at the center decreases most.

On the other hand, in the current drive section 3*c*, fluctuation of the current output is reduced regardless of the position of the drive cell. Thus, the current drive section 3*c* has a shallower curve (broken line curve), as compared with the reference circuit as shown in FIG. 8B. The concave of the curve of the current drive section 3*c* is smaller than that of the reference circuit.

As described above, in the current drive circuit of the fifth embodiment, output current is compensated by the sub current drive section within each cell. Therefore, constant current can be generated from each drive cell regardless of the distance from the electrode to which the power potential VDD is applied. <Sixth Embodiment>The sixth embodiment of the current drive circuit of the present invention is described with reference to FIG. 9.

Figure 9:
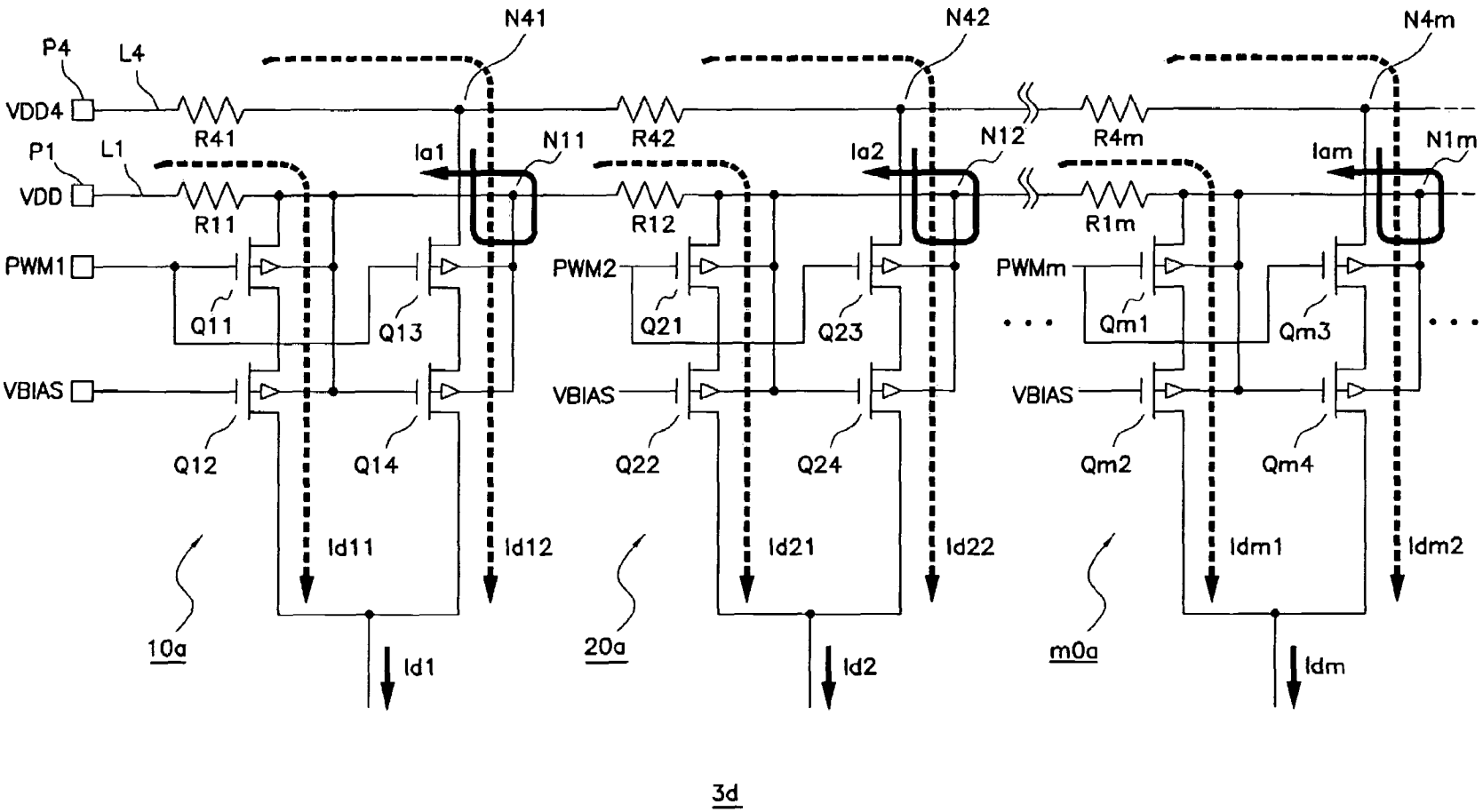
FIG. 9 is a circuit diagram of a current drive section in a current drive circuit according to a sixth embodiment of the present invention.

FIG. 9 is a circuit diagram of a current drive section 3*d* within the current drive circuit according to the sixth embodiment. Although the current drive section 3*d* of the sixth embodiment is similar to the current drive section 3*c* (FIG. 7) of the fifth embodiment, it is different from same in that the substrate of each sub current drive section (Q13 and Q14; Q23 and Q24; . . . , Qm3 and Qm4) is connected to the wiring L1 led from the pad P1 (power potential VDD).

A contact point between the source electrode of the P-channel MOS transistor Qm3 of the drive cell m0*a* and the wiring L4 is referred to as a node Nm4, and a contact point between substrates of the P-channel MOS transistors Qm3 and Qm4 and the wiring L1 is referred to as a node N1*m*. In this embodiment, the potential of the node N4*m* is set higher than the potential of the node N1*m*. For example, when VDD4=VDD, the resistance value of the resistance components of the wiring L1 and wiring L4 are set so that R41<R11, R42<R12, . . . , R4*m*<R1*m* are satisfied.

By performing such setting, voltage V41, V42, . . . , V4*m* between the node N41, N42, . . . , N4*m* and the corresponding node N11, N12, . . . , N1*m* increases with distance from the pad P1. Specifically, V41<V42< . . . <V4*m* is satisfied.

Due to such configuration, in the drive cell m0*a* of the current drive circuit of the sixth embodiment, for example, diode current Iam flows in the direction of node N4*m*→source region (P+ layer) of the P-channel MOS transistor Qm3→substrate (N well)→node N1*m* as shown in FIG. 9 due to a PN structure (diode structure) formed by the source region (P+ layer) of the P-channel MOS transistor Qm3 and the substrate (N well). Similarly, diode current Ia1, Ia2, . . . flow to other drive cells 10*a*, 20*a*, . . . in the same direction as the current Iam.

Since V41<V42< . . . <V4*m* is satisfied, the size of the diode current Ia1, Ia2, . . . , Iam is such that Ia1<Ia2< . . . <Iam. Specifically, the size of the diode current Ia1, Ia2, . . . , Iam becomes larger with the distance from the pad P1.

The diode current Ia1, Ia2, . . . , Iam enters the transistor in the main current drive section of each drive cell and becomes a part of the current of the main current drive section Id11, Id21, . . . , Idm1. Thus, the current drive circuit of the sixth embodiment has better current output characteristics than the current drive section 3*c* (FIG. 7).

Seventh Embodiment

The seventh embodiment of the current drive circuit of the present invention is described next.

A current drive section 3*e* of the current drive circuit of the seventh embodiment is different from those of the first through sixth embodiments in that constant current is caused to be generated from each drive cell by applying the bias potential $V_{BIAS}$ that is different for each drive cell. It should be noted that the present embodiment is based on the assumption that the power potential VDD is greater than the bias potential $V_{BIAS}$.

First, a configuration of the current drive section 3*e* is described with reference to FIG. 10.

Figure 10:
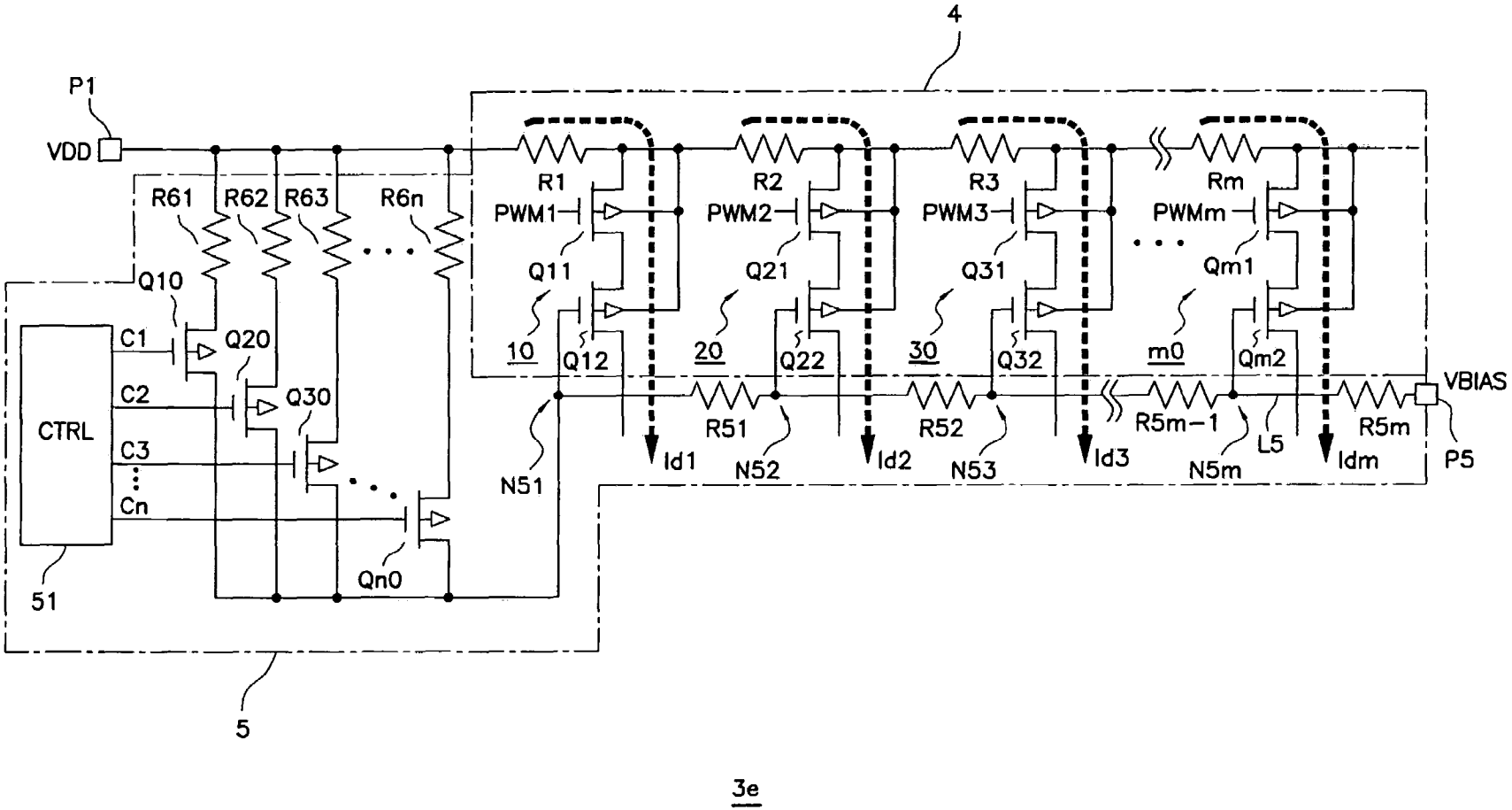
FIG. 10 is a circuit diagram of a current drive section in a current drive circuit according to a seventh embodiment of the present invention.

FIG. 10 is a circuit diagram of the current drive section 3*e* in the current drive circuit according to the seventh embodiment. The current drive section 3*e* has a basic circuit section 4 having a similar circuit configuration to the reference circuit (FIG. 3), and a potential setting section 5 for adjusting the gate potentials of the P-channel MOS transistors Q12, Q22, . . . , Qm2 in order to even the output current Id1, Id2, . . . , Idm.

As shown in FIG. 10, the potential setting section 5 has a plurality of resistance components R51, R52, . . . , R5*m* that are serially arranged between a pad P5 as a fifth terminal (bias potential $V_{BIAS}$ as a fifth reference potential) and the node N51. The resistance components R51, R52, . . . , R5*m* are collectively referred to as a second resistance section. The potential setting section 5 also has a control section 51, a plurality of P-channel MOS transistors Q10, Q20, . . . , Qn0, and a plurality of resistance components R61, R62, . . . , R6*n* between the node N51 and the pad P1 (power potential VDD). The resistance components R61, R62, . . . , R6*n* are collectively referred to as a third resistance section.

The control section 51 adjusts impedance between the pad P1 (power potential VDD) and the pad P5 (bias potential $V_{BIAS}$) in accordance with a request value (required value) of the output current Id1, Id2, . . . , Idm.

The control section 51 is connected to each gate electrode of each of the P-channel MOS transistors Q10, Q20, . . . , Qn0 and transmits a control signal C1, C2, . . . , Cn to each gate. The resistance components R61, R62, . . . , R6*n* are connected to the source electrodes of the P-channel MOS transistors Q10, Q20, . . . , Qn0, respectively. The drain electrodes of the P-channel MOS transistors Q10, Q20, . . . , Qn0 are connected to the node N51 in common.

The control section 51 sets any of the control signals C1, C2, . . . , Cn to a low level (active) signal, and sets other signals to high level (non-active) signals in accordance with a request value of the output current Id1, Id2, . . . , Idm.

As shown in FIG. 10, a node N52, N53, . . . , N5*m* between two adjacent resistance components of the resistance components R51, R52, . . . , R5*m* is connected to a gate electrode of a P-channel MOS transistor Q22, Q23, . . . , Qm2. For example, the node N52 between the resistance component R51 and resistance component R52 is connected to the gate electrode of the P-channel MOS transistor Q22 on a wiring L5 led from the pad P5, and the node N5*m* between the resistance component R5*m*−1 and resistance component R5*m* is connected to the gate electrode of the P-channel MOS transistor Qm2.

Figure 11A:
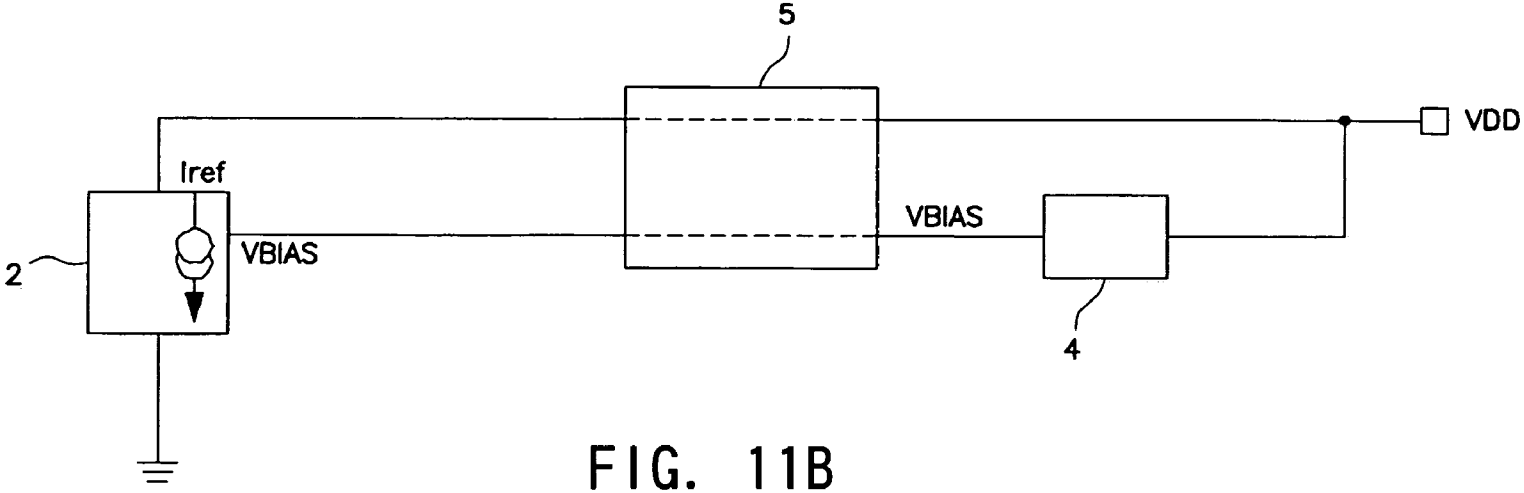
FIG. 11A shows an example of layout of a basic circuit section and potential setting section within the current drive circuit of the seventh embodiment on an IC.
Figure 11B:
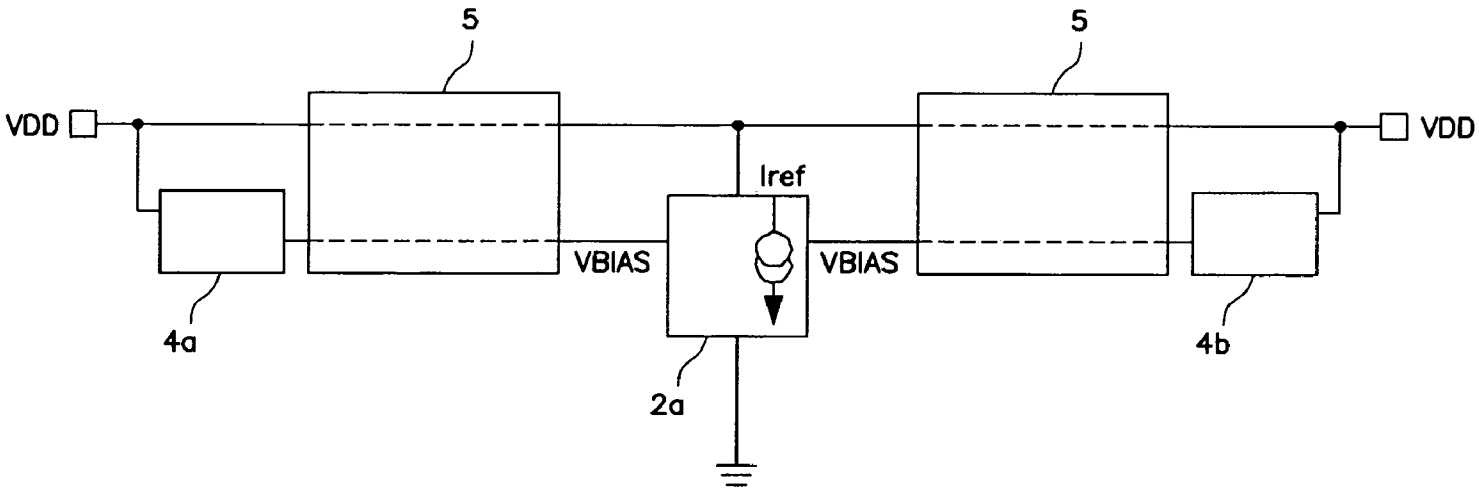
FIG. 11B shows another example of the layout of the basic circuit section and potential setting section within the current drive circuit of the seventh embodiment.

FIG. 11A and FIG. 11B show examples of layouts of the basic circuit section 4 and potential setting section 5 within the current drive circuit of the seventh embodiment on an IC. FIG. 11A shows a configuration for the case where one pad P1 as the power potential VDD is provided on the IC, and FIG. 11B shows a configuration for the case where two pads P1 as the potential VDD are provided at both ends on the IC. It should be noted that the reference voltage generating circuit section 2 is same as the one shown in FIG. 1, and a reference voltage generating circuit section 2*a* is different from the reference voltage generating circuit section 2 in that two output sections for the bias voltage $V_{BIAS}$ are provided in the reference voltage generating circuit section 2*a*.

As shown in FIG. 10, in the current drive section 3*e* (basic circuit section 4 and potential setting section 5) the pad P5 (bias potential $V_{BIAS}$) is provided at a position in the basic circuit section 4 having a plurality of drive cells so as to be distant from the pad P1 (power potential VDD). Therefore, as shown in FIG. 11B, when there are two pads P1 (power potential VDD) on both ends, the reference voltage generating circuit section 2*a* that generates the bias voltage $V_{BIAS}$ is disposed in the center, and the drive cells are divided into two and then disposed on right and left sides (basic circuit sections 4*a*, 4*b*). In this manner, even when there are two pads P1 (power potential VDD) on the both ends, the pad P1 and pad P5 can be distant from each other in the current drive section 3d.

Next, the operation of the current drive section 3*e* of the seventh embodiment is described.

In FIG. 10, if the request value to the output current of each drive cell in the current drive section 3*e* is given to the control section 51 from the outside, or if the request value is set in the control section 51 beforehand, the control section 51 makes one of the control signals C1, C2, . . . , Cn be the low level (active) signal and other signals be the high level (non-active) signals in accordance with the request value. Accordingly, out of the n P-channel MOS transistors Q10, Q20, Qn0, a single P-channel MOS transistor whose gate electrode is applied with the low level signal is turned ON.

For example, if, out of the n P-channel MOS transistors Q10, Q20, . . . , Qn0, only the P-channel MOS transistor Q10 is applied with the low level signal, the P-channel MOS transistor Q10 is turned ON, and the resistance component R61 and resistance components R51, R52, . . . , R5*m* are connected serially with each other between the pad P1 and pad P5.

If the potentials of the nodes N51, N52, . . . , N5*m* between the pad P5 and node N51 are taken as PN51, PN52, . . . , PN5*m* respectively, then PN51>PN52> . . . >PN5*m* is satisfied. Specifically, the potentials of the nodes N51, N52, . . . , N5*m*, i.e., the gate potentials of the P-channel MOS transistors Q12, Q22, . . . , Qm2, become smaller with distance from the pad P1. Such potential setting is realized by providing the pad P5 to be distant from the pad P1.

On the other hand, in the basic circuit section 4, the source potentials of the P-channel MOS transistors Q12, Q22, . . . , Qm2 decrease with the distance from the pad P1 (starting from the closest P-channel MOS transistor Q12 to the farthest P-channel MOS transistor Qm2) because voltage is reduced by the parasitic resistance components R1, R2, . . . , Rm of the power wiring.

Therefore, fluctuation of the gate-to-source voltage $V_{GS}$ of each P-channel MOS transistor Q12, Q22, . . . , Qm2 within each drive cell becomes small regardless of the distance from the pad P1 to the drive cells. Thus, substantially constant current can be produced from all the drive cells.

When reducing the output current of each drive cell, the control section 51 selects a-resistance component having a resistance value smaller than that of the resistance component R61, out of the resistance components R62, R63, . . . , R6*m*. For example, in the case of R61>R62, the control section 51 applies the low level signal to the P-channel MOS transistor Q20 only. Accordingly, the P-channel MOS transistor Q20 is turned ON, and the resistance component R62 and the resistance components R51, R52, . . . , R5*m* are serially connected with each other between the pad P1 and pad P5. Since the resistance R61 is greater than the resistance R62, each potential PN51, PN52, . . . , PN5*m* of the node N51, N52, . . . , N5*m* increases, compared to the case where the resistance component R51 is selected. The gate-to-source voltage $V_{GS}$ of the P-channel MOS transistor Q12, Q22, . . . , Qm2 in each drive cell decreases entirely or generally, compared to the case where the resistance component R51 is selected. Thus the output current Id1, Id2, . . . , Idm from each drive cell decreases.

It should be noted that if a static driver or the like is considered, a constant current value of the output current Id1, Id2, . . . , Idm from each drive cell is fixed. In this case, a single resistance component suited for the constant current value is provided between the pad P1 and the node N51.

The P-channel MOS transistor Q10, Q20, . . . , Qn0 may be an arbitrary switching element that operates in response to the control signals from the control section 51, and can be replaced with, for example, a bipolar transistor.

Figure 12:
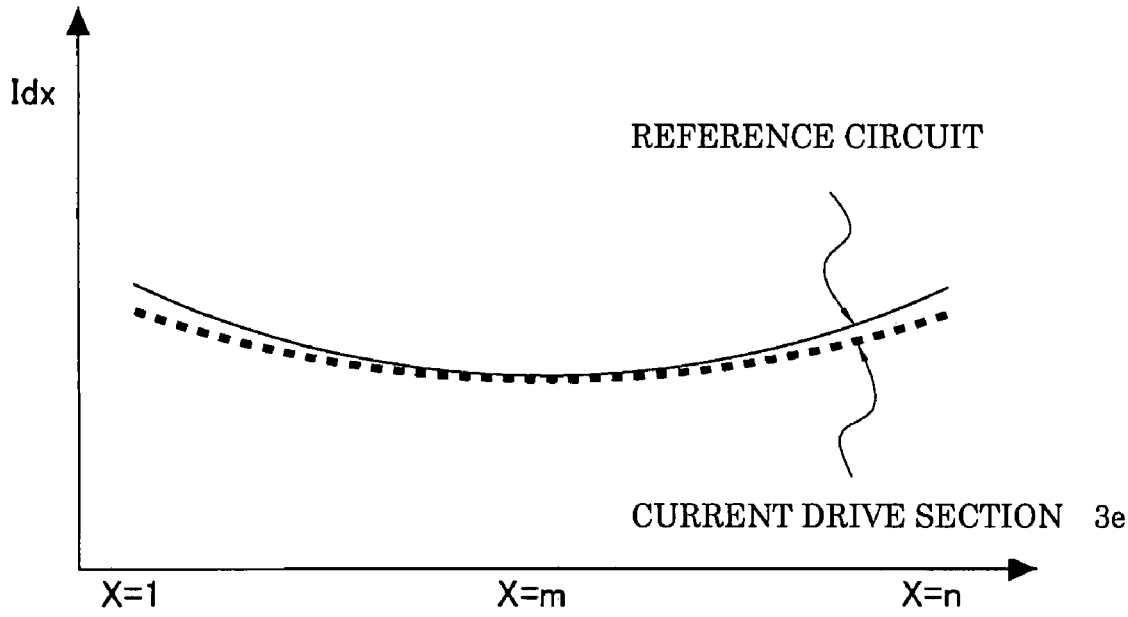
FIG. 12 shows current output characteristics of the current drive circuit according to the seventh embodiment.

FIG. 12 shows the current output characteristics of the current drive section 3*e* of the present embodiment. The current output characteristics show the characteristics when n (n>m) drive cells 10, 20, . . . , m0, . . . , n0 are provided in the circuit shown in FIG. 11B. Some drive cells 10, 20, . . . , m0 are disposed in the basic circuit section 4a and the rest of the drive cells $m_{+1}$0, . . . , n0 are disposed in the second basic circuit section 4*b*. The pads P1 are positioned at both ends on the IC. The horizontal axis of the graph represents the positions of the drive cells and the vertical axis represents the output current of each drive cell.

When the power potential VDD is applied from the both sides of the IC, the current decreases starting from the drive cell proximal to the electrode (power potential VDD) to the drive cell distal from the electrode in the reference circuit. Specifically, the current output characteristics of the reference circuit show concave characteristics (solid line curve) in which the current output of the drive cell positioned in the middle deceases most.

On the other hand, in the current output characteristics of the current drive section 3*e*, fluctuation of the current output is reduced regardless of the positions of the drive cells. Thus, the current drive section 3*e* has a relatively (or generally) flat curve, as compared with the solid line curve of the reference circuit, as shown in FIG. 12.

As described above, in the current drive circuit of this embodiment, the pad P5 (bias potential $V_{BIAS}$) is provided to be distant from the pad P1 (power potential VDD), and the gate potential of the P-channel MOS transistor of each drive cell decreases from the proximal drive cell (with respect to the pad P1) to the distal drive cell in the current drive section 3*e*. Thus, the influence of the decrease in source potential of the P-channel MOS transistor, which is due to the power wiring, is suppressed. Therefore, the constant current can be generated from each drive cell regardless of the distance from the electrodes to which the power potential VDD is applied.

Eighth Embodiment

The eighth embodiment of the current drive circuit of the present invention is described with reference to FIG. 13.

In the current drive circuit of the seventh embodiment, the pad P5 (bias potential $V_{BIAS}$) is provided to be distant from the pad P1 (power potential VDD) on the IC, but the case where the pad P1 and pad P5 are inevitably positioned close to each other can be assumed because of the restrictions on the layout of the IC. The eighth embodiment deals with the current drive circuit for the case where the pad P1 and the pad P5 are positioned close to each other.

A current drive section 3*f* of the current drive circuit of the eighth embodiment is similar to the current drive section 3*e* of the sixth embodiment in that the constant current is generated from each drive cell by applying the bias potential $V_{BIAS}$ that is different for each drive cell, but is different from that of the sixth embodiment in terms of the configuration of the potential setting section for adjusting the gate potential of each P-channel MOS transistor Q12, Q22, . . . , Qm2 because the pad P1 and the pad P5 are positioned close to each other. The configurations of the parts other than the potential setting section in the current drive section 3*f* are same as those of the current drive section 3*e*.

A configuration of the current drive section 3*f* of the eighth embodiment is described hereinafter.

Figure 13:
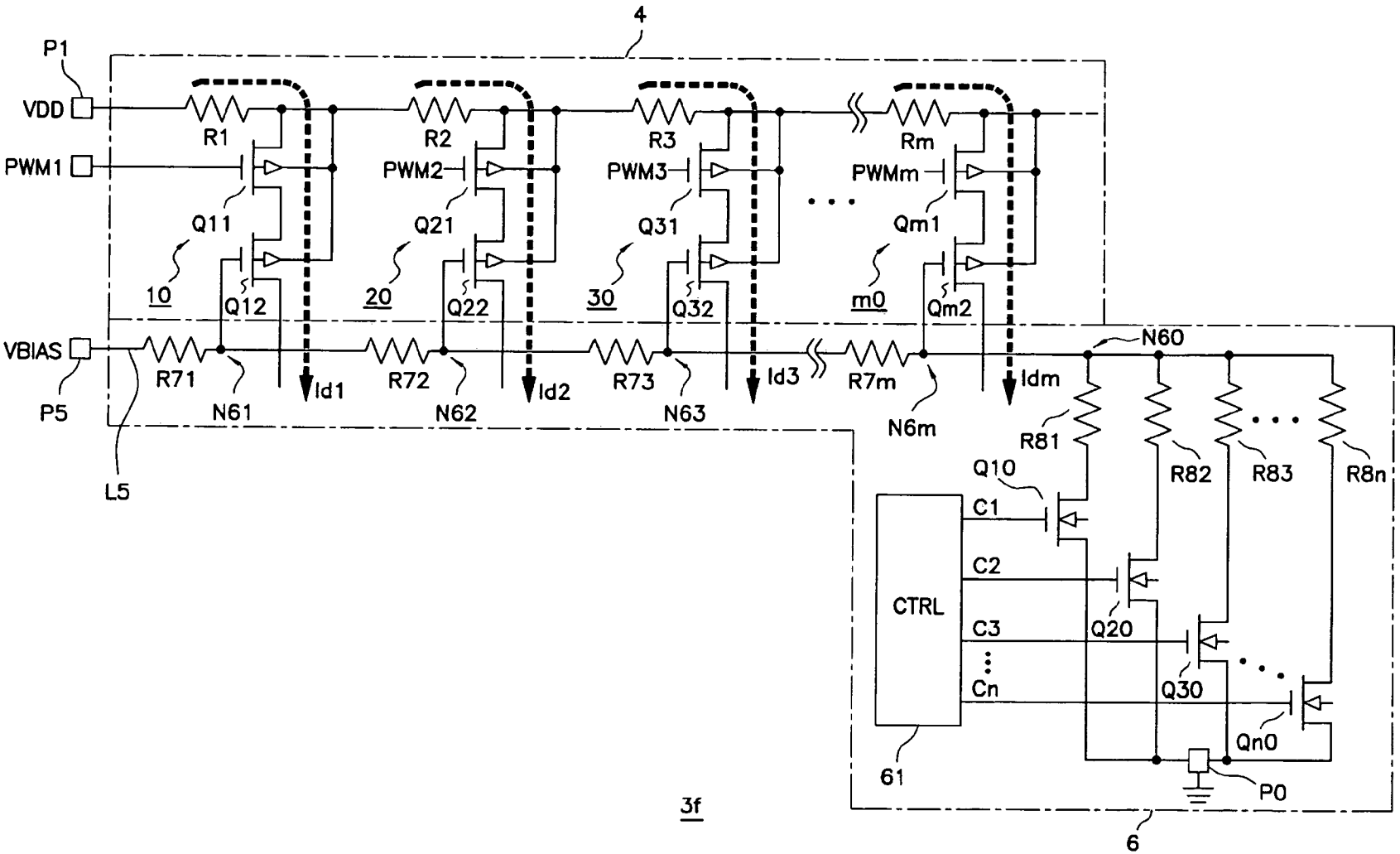
FIG. 13 is a circuit diagram of a current drive section in a current drive circuit according to an eighth embodiment of the present invention.

FIG. 13 is a circuit diagram of the current drive section 3*f* in the current drive circuit of the eighth embodiment. The current drive section 3*f* has a basic circuit section 4 having a similar circuit configuration to the reference circuit, and a potential setting section 6 for adjusting the gate potential of each P-channel MOS transistor Q12, Q22, . . . , Qm2 in order to even the output current Id1, Id2, . . . , Idm.

As shown in FIG. 13, the potential setting section 6 has a plurality of resistance components R71, R72, . . . , R7*m* that are serially arranged between the pad P5 (bias potential $V_{BIAS}$) and a node N60. The resistance components R71, R72, . . . , R7*m* are collectively referred to as a second resistance section. The potential setting section 6 has a control section 61, a plurality of P-channel MOS transistors Q10, Q20, . . . , Qn0, and a plurality of resistance components R81, R82, . . . , R8n between the node N60 and the pad P1 (power potential VDD). The resistance components R81, R82, . . . , R8n are collectively referred to as a third resistance section.

The control section 61 adjusts impedance between the pad P5 (bias potential $V_{BIAS}$) and the pad P0 (GND potential or ground potential) in accordance with a request value of the output current Id1, Id2, . . . , Idm.

The control section 61 is connected to a gate electrode of each of the P-channel MOS transistors Q10, Q20, . . . , Qn0 and transmits a control signal C1, C2, . . . , Cn to each gate. The resistance components R81, R82, . . . , R8*n* are connected to the source electrodes of the P-channel MOS transistors Q10, Q20, Qn0 respectively. The drain electrodes of the P-channel MOS transistors Q10, Q20, . . . , Qn0 are connected to the node N60 in common.

The control section 61 sets any of the control signals C1, C2, . . . , Cn to a low level (active) signal, and sets other signals to high level (non-active) signals in accordance with a request value of the output current Id1, Id2, . . . , Idm.

As shown in FIG. 13, a node N61, N62, . . . , N6*m* between two adjacent resistance components of the resistance components R71, R72, . . . , R7*m* is connected to a gate electrode of a corresponding P-channel MOS transistor Q12, Q22, . . . , Qm2. For example, the node N61 between the resistance component R71 and resistance component R72 on a wiring L5 led from the pad P5 is connected to the gate electrode of the P-channel MOS transistor Q12, the node N62 between the resistance component R72 and resistance component R73 on the wiring L5 is connected to the gate electrode of the P-channel MOS transistor Q22, and the node 6*m* between the resistance component R7*m* and node N60 on the wiring L5 is connected to the gate electrode of the P-channel MOS transistor Qm2.

Figure 14A:
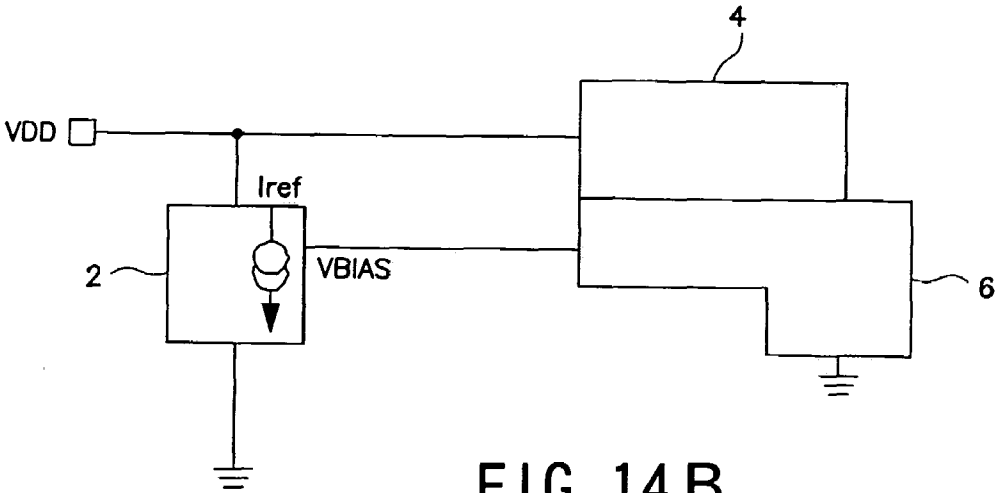
FIG. 14A shows an example of layout of a basic circuit section and potential setting section within the current drive circuit of the eighth embodiment on an IC.
Figure 14B:
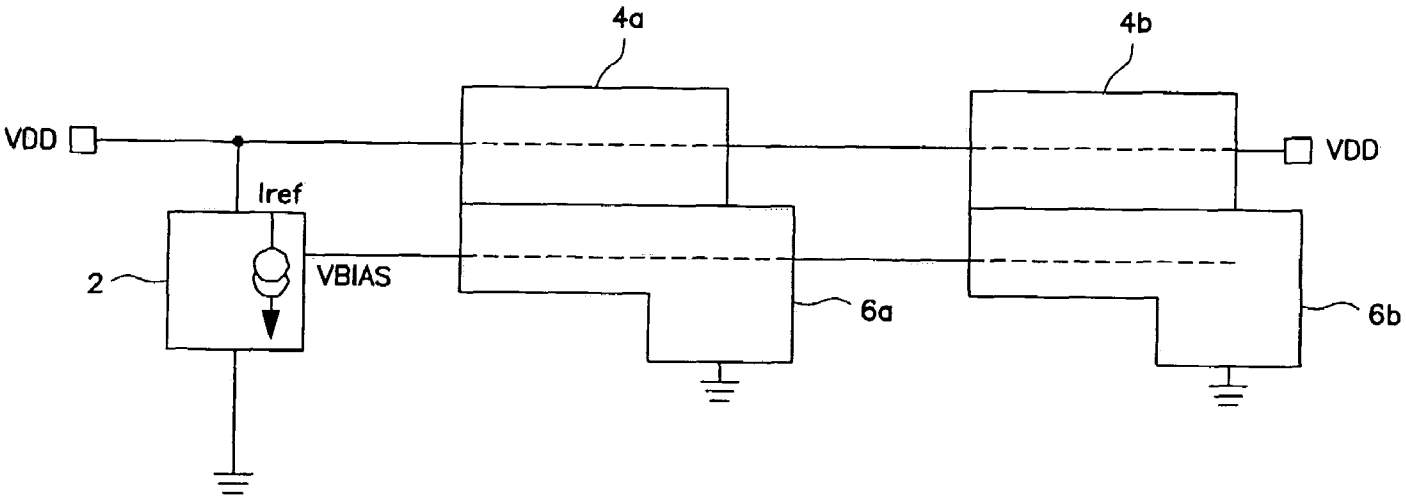
FIG. 14B shows another example of the layout of the basic circuit section and potential setting section within the current drive circuit of the eighth embodiment.

FIG. 14A and FIG. 14B show examples of layouts of the basic circuit section 4 and potential setting section 6 within the current drive circuit of the eighth embodiment on an IC. FIG. 14A shows a configuration for the case where one pad P1 as the power potential VDD is provided on an IC, and FIG. 14B shows a configuration for the case where two pads P1 as the potential VDD are provided at both ends on the IC. It should be noted that the reference voltage generating circuit section 2 is the same as the one shown in FIG. 1.

As shown in FIG. 14A, when there is only one pad P1 (power potential VDD), the potential setting section 6 suited for the basic circuit section 4 is provided between the bias potential $V_{BIAS}$ and the GND potential so as to have the circuit configuration equivalent to the one shown in FIG. 13.

As shown in FIG. 14B, when there are two pads P1 (power potential VDD) on both ends, the drive cells are dividedly disposed in the basic circuit sections 4*a*, 4*b* in the vicinity of the pads P1 at the both ends in order to reduce the influence of the parasitic resistance components of the power wiring. Then, potential setting sections 6*a*, 6*b* suited for the two basic circuit sections 4*a*, 4*b* are provided between the bias potential $V_{BIAS}$ and the GND potential.

Next, the operation of the current drive section 3*f* of the eighth embodiment is described.

In FIG. 13, if the request value for the amount of the output current of each drive cell in the current drive section 3*f* is given to the control section 61 from the outside, or if the request value has been entered in the control section 61 beforehand, the control section 61 sets any of the control signals C1, C2, . . . , Cn to the low level (active) signal and other signals to the high level (non-active) signals in accordance with the request value. Accordingly, out of the n P-channel MOS transistors Q10, Q20, . . . , Qn0, a single P-channel MOS transistor whose gate electrode is applied with the low level signal is turned ON.

For example, if, out of the n P-channel MOS transistors Q10, Q20, . . . , Qn0, only the P-channel MOS transistor Q10 is applied with the low level signal, the P-channel MOS transistor Q10 is turned ON, and the resistance component R81 and resistance components R71, R72, . . . , R7*m* are connected serially with each other between the pad P5 and pad P0.

If the potentials of the nodes N61, N62, . . . , N6*m* between the pad P5 and node N60 are taken as PN61, PN62, . . . , PN6*m* respectively, PN61>PN62> . . . >PN6*m* is satisfied. Specifically, the potentials of the nodes N61, N62, . . . , N6*m*, i.e., the gate potentials of the P-channel MOS transistors Q12, Q22, . . . , Qm2, become smaller with distance from the pad P1. Such potential setting is realized by providing the pad P0, which is the GND potential, in the position distant (opposite) from the pad P1.

On the other hand, in the basic circuit section 4, the source potentials of the P-channel MOS transistors Q12, Q22, . . . , Qm2 decrease, starting from the P-channel MOS transistor Q12 to the P-channel MOS transistor Qm2, with the distance of the drive cell from the pad P1 because voltage is reduced by the parasitic resistance components R1, R2, . . . , Rm of the power wiring.

Therefore, fluctuation of the gate-to-source voltage $V_{GS}$ of each P-channel MOS transistor Q12, Q22, . . . , Qm2 within each drive cell becomes small regardless of the distance from the pad P1 to the drive cells. Thus, substantially constant current can be generated from all the drive cells.

When reducing the output current of each drive cell, the control section 61 selects a resistance component having a resistance value greater than that of the resistance component R81, out of the resistance components R82, R83, . . . , R8*m*. For example, in the case of the resistance value of the resistance component R81 being smaller than that of the resistance component R82 (R81<R82), the control section 51 applies the low level signal to the P-channel MOS transistor Q20 only. Accordingly, the P-channel MOS transistor Q20 is turned ON, and the resistance component R82 and the resistance components R71, R72, . . . , R7*m* are serially connected with each other between the pad P1 and pad P5. Since R81 is smaller than R82, each potential PN61, PN62, . . . , PN6*m* of the node N61, N62, . . . , N6*m* increases, compared to the case where the resistance component R81 is selected. Also, the gate-to-source voltage $V_{GS}$ of the P-channel MOS transistor Q12, Q22, . . . , Qm2 in each drive cell decreases generally or entirely, compared to the case where the resistance component R81 is selected. Thus, the output current Id1, Id2, Idm that is generated from each drive cell decreases.

It should be noted that, for a static driver or the like, when a constant value of the output current Id1, Id2, . . . , Idm from each drive cell is not changed, a single resistance component corresponding to the constant current value may be provided between the node N60 and the pad P0.

The P-channel MOS transistor Q10, Q20, . . . , Qn0 may be a switching element that operates in response to the control signals from the control section 61, and can be replaced with, for example, a bipolar transistor.

Figure 15:
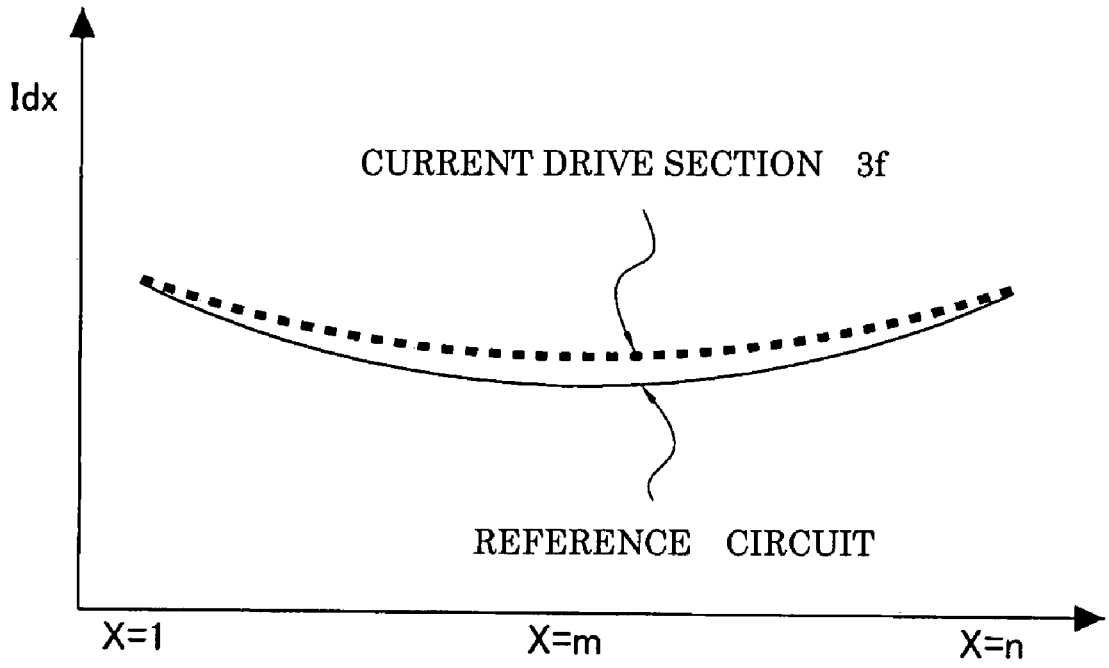
FIG. 15 shows current output characteristics of the current drive circuit according to the eighth embodiment.

FIG. 15 shows the current output characteristics of the current drive section 3*f* of the eighth embodiment. The current output characteristics show the characteristics of the FIG. 14B circuit having the pads P1 on the both ends on the IC and having n (n>m) drive cells 10, 20, . . . , m0, . . . , n0. Some drive cells 10, 20, . . . , m0 are disposed in the basic circuit section 4*a* and the rest of the drive cells $m_{+1}$, . . . , n0 are disposed in the basic circuit section 4*b*. The horizontal axis of the graph of FIG. 15 represents the position of the drive cell and the vertical axis of this graph represents the output current of the drive cell.

When the power potential VDD is applied from the both sides of the IC in this manner in the reference circuit, the current decreases starting from the drive cell proximal to the electrode (power potential VDD) to the drive cell distal from the electrode in the reference circuit. Specifically, the current output characteristics of the reference circuit show concave characteristics in which the current output of the drive cell positioned in the middle deceases most.

On the other hand, in the current output characteristics of the current drive section 3*f*, fluctuation of the current output is reduced regardless of the positions of the drive cells. Thus, as shown in FIG. 15, the current drive section 3*f* has a relatively flat curve of characteristics, as compared with the reference circuit of FIG. 3.

As described above, in the current drive section 3*f* of the current drive circuit of the eighth embodiment, the potential setting section is provided between the pad P5 (bias potential $V_{BIAS}$) and the pad P0 (GND potential), and the gate potential of the P-channel MOS transistor decreases with the distance of the drive cell to the pad P1. Thus, the influence of the decrease in the source potentials of the P-channel MOS transistors, which is due to the power wiring, is reduced. Therefore, the constant current can be generated from each drive cell regardless of the distance from the electrode(s) to which the power potential VDD is applied.

Ninth Embodiment

The ninth embodiment of the current drive circuit of the present invention is described with reference to FIG. 16.

Figure 16:
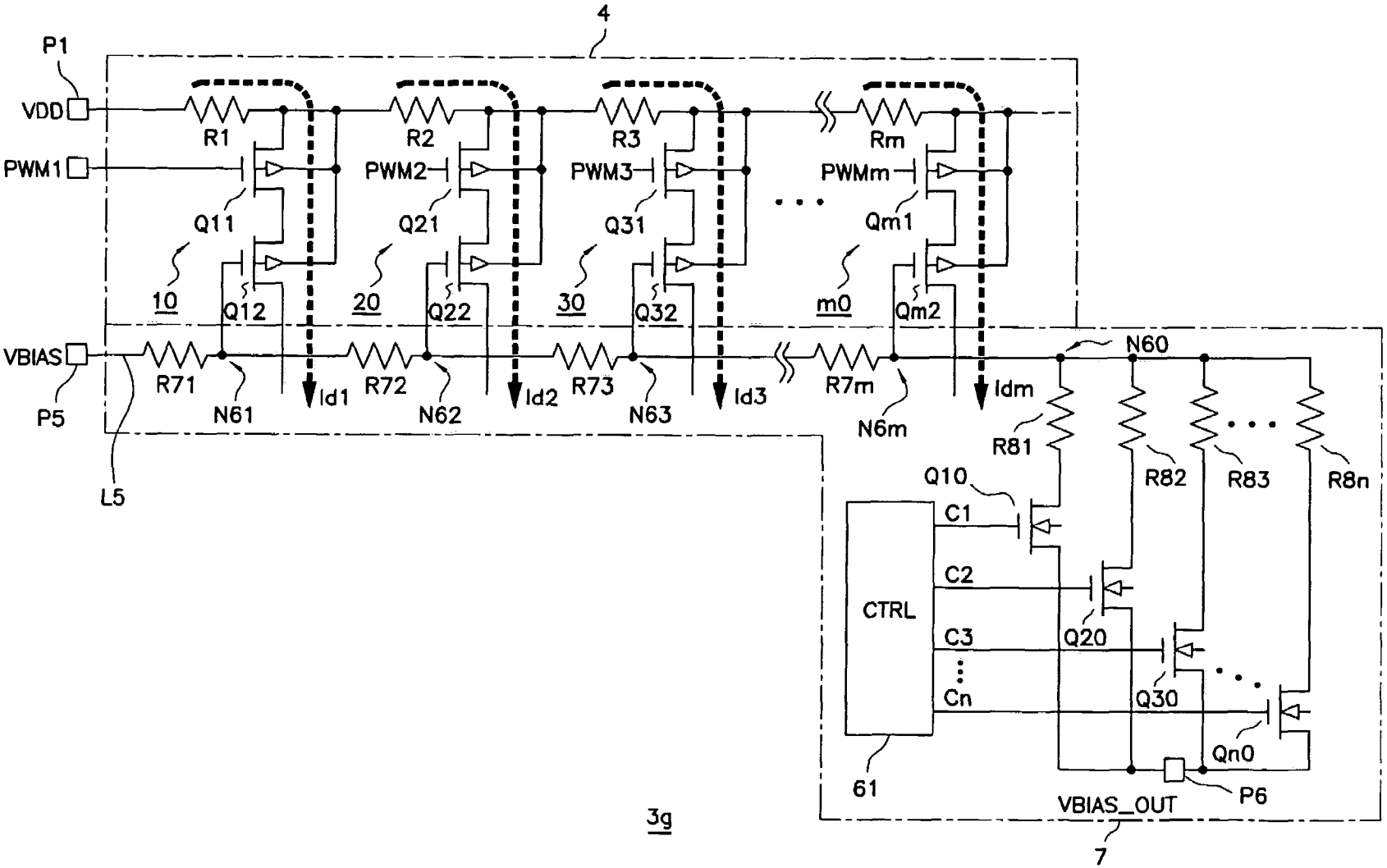
FIG. 16 is a circuit diagram of a current drive section in a current drive circuit according to a ninth embodiment of the present invention.

FIG. 16 is a circuit diagram of a current drive section 3*g* in the current drive circuit of the ninth embodiment. As is clear from the comparison between FIG. 16 and FIG. 15, the current drive section 3*g* of the ninth embodiment is different from the current drive section 3*f* of the eighth embodiment only in that the electrode connected to the potential setting section 7 is not the pad P0 (GND potential) but a pad P6 (potential VBIAS_OUT).

The value of the potential VBIAS_OUT in the pad P6 may be set arbitrarily as long as it is lower than the bias potential $V_{BIAS}$ of the pad P5. The pad P6 (potential VBIAS_OUT) can be set to a desired potential by connecting the electrode to the GND potential via a separate variable resistance component to the pad P6. The separate variable resistance component exists outside the IC.

By changing the potential VBIAS_OUT, the potential of each node N60, N61, . . . , N6*m* changes even if the same resistance component is selected from among the resistance components R82, R83, . . . , R8*m*. Thus, the output current Id1, Id2, . . . , Idm changes.

As described above, in the current drive circuit of the ninth embodiment, the potential VBIAS_OUT of the pad P6 can be set to a desired value by means of the variable resistance component of the outside of the IC, and the amount of the output current of each drive cell can be adjusted from the outside. Therefore, in the case where the current drive circuit of the ninth embodiment is used in various display devices, the current output characteristics can be optimized in accordance with the display devices.

The foregoing has described the embodiments of the present invention in detail, but the present invention is not limited to the specific configurations and systems of the embodiments. Changing of designs or application to other systems will also fall in the scope of the present invention.

This application is based on Japanese Patent Application No. 2006-155556 filed on Jun. 5, 2006, and the entire disclosure thereof is incorporated herein by reference.

What is claimed is:

1. A current drive circuit comprising:

a first power source pad provided on a chip;

a second power source pad provided on said chip at a different position from said first power source pad;

first wiring which is lead from the first power source pad;

second wiring which is lead from the second power source pad; and a current drive section, which has a plurality of transistor elements whose one ends are connected in parallel to the first wiring such that each of said plurality of transistor elements is turned on or off in response to a signal supplied from a gate of each of said plurality of transistor elements, wherein the second wiring is connected to substrate terminal of the plurality of transistor elements of the current drive section;

wherein an end of the first wiring is connected to an end of the second wiring.

2. The current drive circuit according to claim 1, further comprising a first resistance section having one or a plurality of resistance elements on the second wiring, wherein the first wiring and the second wiring are connected to the transistor element which is positioned farthest from the first power source pad, out of the plurality of transistor elements.

3. The current drive circuit according to claim 1, wherein the plurality of transistor elements of the current drive section are formed by a common substrate or a well region.

4. The current drive circuit according to claim 1, wherein a potential supplied to the first power source pad is equal to a potential supplied to the second power source pad.

5. A current drive circuit comprising:

a first terminal which is set to a first reference potential;

a fourth terminal which is set to a fourth reference potential;

a main current drive section, which has a plurality of first transistor elements whose source electrodes and substrates are connected in parallel to the first terminal, for generating drain current as output current from each said first transistor element in accordance with a gate potential; and a sub current drive section which has a plurality of second transistor elements associated with the plurality of first transistor elements respectively and whose source electrodes and substrates are connected in parallel to the fourth terminal, the gate electrode of each said second transistor element being connected to the source electrode of said associated first transistor element.

6. The current drive circuit according to claim 5, wherein the substrate of each said second transistor element of the sub current drive section is connected to the source of the associated first transistor element of the main current drive section.

7. A current drive circuit comprising:

a first terminal which is set to a first reference potential;

first wiring which is led from the first terminal;

a fifth terminal which is set to a fifth reference potential lower than the first reference potential;

a current drive section, which has a plurality of transistor elements whose source electrodes are connected in parallel to the first wiring, for generating drain current from each said transistor element in accordance with a gate potential which is applied to gate electrodes of the plurality of transistor elements; and a potential setting section which causes the gate potentials of the plurality of transistor elements to decrease sequentially starting from the transistor element proximal to the first terminal to the transistor element distal from the first terminal;

wherein the potential setting section comprises a second resistance section having a plurality of resistance elements which are provided serially between the first terminal and the fifth terminal, and a node between each said two adjacent resistance elements and a gate electrode of a corresponding one of the plurality of transistor elements is connected to each other.

8. The current drive circuit according to claim 7, wherein the potential setting section comprises:

a third resistance section having a plurality of resistance elements which are provided in parallel between the first terminal and the fifth terminal and have resistance values different from one another; and a control section which selects one said resistance element from the third resistance section to control the gate potentials of the plurality of transistor elements in accordance with a request value for the output current.

* * * * *